US012195059B2

(12) United States Patent
Thiyagarajan et al.

(10) Patent No.: US 12,195,059 B2
(45) Date of Patent: Jan. 14, 2025

(54) VEHICLE CONTROL SYSTEM

(71) Applicant: Transportation IP Holdings, LLC, Norwalk, CT (US)

(72) Inventors: Saravanan Thiyagarajan, Bangalore (IN); Ankit Sharma, Bangalore (IN); Prakarsh Paritosh, Bangalore (IN); David Allen Eldredge, Melbourne, FL (US); William Cherrick Schoonmaker, Melbourne, FL (US); Kaitlyn Ann Hrdlicka, Lawrence Park, PA (US); Joseph Daniel Wakeman, Lawrence Park, PA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 461 days.

(21) Appl. No.: 17/562,187

(22) Filed: Dec. 27, 2021

(65) Prior Publication Data

US 2022/0119020 A1 Apr. 21, 2022

Related U.S. Application Data

(63) Continuation-in-part of application No. 16/262,438, filed on Jan. 30, 2019, now Pat. No. 11,208,125, which is a continuation-in-part of application No. PCT/US2017/042516, filed on Jul. 18, 2017, which is a continuation of application No. 15/231,078, filed on Aug. 8, 2016, now Pat. No. 10,279,823.

(51) Int. Cl.

| | |
|---|---|
| ***B61L 15/00*** | (2006.01) |
| ***B61L 3/02*** | (2006.01) |
| ***B61L 27/14*** | (2022.01) |

(52) U.S. Cl.
CPC ..... *B61L 15/0058* (2024.01); *B61L 3/02* (2013.01); *B61L 15/0062* (2024.01); *B61L 27/14* (2022.01)

(58) Field of Classification Search
CPC .. B61L 15/0058; B61L 15/0062; B61L 27/14; B61L 3/02
USPC ..... 701/20
See application file for complete search history.

(56) References Cited

U.S. PATENT DOCUMENTS

| | | | | |
|---|---|---|---|---|
| 6,462,675 | B1 * | 10/2002 | Humphrey | G08G 1/052 340/936 |
| 7,711,468 | B1 * | 5/2010 | Levy | B60W 30/143 701/32.4 |
| 9,168,936 | B2 | 10/2015 | Grimm et al. | |
| 2007/0225878 | A1 * | 9/2007 | Kumar | B61L 15/0058 701/19 |

(Continued)

FOREIGN PATENT DOCUMENTS

| | | | | |
|---|---|---|---|---|
| AU | 2012348341 | A1 * | 6/2014 | B61L 27/0016 |
| CA | 2768484 | A1 * | 8/2012 | B60W 30/146 |

(Continued)

*Primary Examiner* — Atul Trivedi
(74) *Attorney, Agent, or Firm* — K&L Gates LLP

(57) ABSTRACT

A control system includes a controller that may determine whether a second speed limit, which is less than or equal to a first speed limit, is in effect for a segment of the route. The controller may switch one or more operational settings of a vehicle from the first speed limit to the second speed limit, and may operate the vehicle at the first speed limit outside of the segment of the route and operate the vehicle at or below the second speed limit while the vehicle is approaching or within the segment of the route.

20 Claims, 7 Drawing Sheets

(56) References Cited

U.S. PATENT DOCUMENTS

| | | | | |
|---|---|---|---|---|
| 2010/0161195 | A1* | 6/2010 | Shin | B60W 10/18 701/93 |
| 2011/0160978 | A1* | 6/2011 | Yuzawa | B60W 30/146 701/93 |
| 2014/0188306 | A1* | 7/2014 | Kumar | B61C 17/12 701/2 |
| 2014/0188375 | A1* | 7/2014 | Kumar | G06F 17/00 701/117 |
| 2015/0104757 | A1* | 4/2015 | Moncrief | G09B 9/05 434/30 |
| 2015/0168158 | A1* | 6/2015 | Mathews, Jr. | B61L 15/0062 701/400 |
| 2016/0091320 | A1* | 3/2016 | Kapp | B61L 3/16 701/1 |
| 2016/0257323 | A1* | 9/2016 | Meyer | B61L 27/16 |

FOREIGN PATENT DOCUMENTS

| | | | | |
|---|---|---|---|---|
| EP | 2168831 | A1 * | 3/2010 | B60W 10/08 |
| FR | 2835348 | A1 * | 8/2003 | B60K 31/0058 |
| GB | 2445291 | A * | 7/2008 | B60K 31/047 |
| GB | 2454516 | A * | 5/2009 | B60K 31/18 |

* cited by examiner

VEHICLE CONTROL SYSTEM

CROSS-REFERENCE TO RELATED APPLICATIONS

This application is a continuation-in-part of U.S. patent application Ser. No. 16/262,438, filed 30 Jan. 2019, which is a continuation-in-part of International Patent Application PCT/US2017/042516, filed 18 Jul. 2017, which claims priority to U.S. patent application Ser. No. 15/231,078, filed 8 Aug. 2016. The entire disclosures of these patent applications are incorporated herein by reference.

FIELD

Embodiments of the subject matter described herein relate to controlling or monitoring one or more vehicle systems as the vehicle systems travel along routes.

BACKGROUND

Some known vehicle systems may travel according to a designated plan that provides instructions for the vehicle system to implement during movement of the vehicle system so that the vehicle system meets or achieves certain objectives during the trip. The designated plan (called trip plan) can be generated by an onboard or off-board controller (or control system) and may dictate operational settings (e.g., power and braking) as a function of time, location, distance, and/or other parameters. For example, a trip plan for a vehicle system may dictate throttle settings, brake settings, speeds, etc. of the vehicle system as a function of time, location, distance, and/or other parameters. Objectives for a trip may include reaching an arrival location at or before a predefined arrival time, increasing fuel efficiency (relative to the fuel efficiency of the vehicle system traveling without following the trip plan), abiding by speed limits and emissions limits, and the like. One known system, the Trip Optimizer™ system of Westinghouse Air Brake Technologies Corporation, can create a trip plan by collecting various input information related to the vehicle system and the trip, such as the length and weight of the vehicle system, the grade and conditions of the route that the vehicle system will be traversing, weather conditions, performance of the vehicle system, or the like.

In addition to the trip plan, enterprises may use a communication system to monitor and instruct vehicle systems as the vehicle systems travel along the routes. In the context of railway operations, one such example is a positive train control (PTC) system that monitors the locations of numerous vehicle systems in a network of routes and communicates with the vehicle systems to prevent collisions or other unsafe traveling conditions. The PTC system operates by determining which segments of routes are occupied or are undergoing maintenance, for example, and generate signals that inform the respective vehicle systems as to whether the vehicle systems can enter into certain route segments.

For either the control system generating a trip plan or the communication system monitoring the numerous vehicle systems, the input information used by the respective system may include one or more "slow orders" that have been issued for segments of the route. A slow order restricts speeds at which a vehicle system may travel through the respective segment of the route. A slow order may be applied, for example, to a segment of the route where individuals (e.g., construction workers, inspectors, or the like) may be located near the route or where conditions of the route may be poor (e.g., debris along the route).

A single trip for a vehicle may be hundreds of kilometers or more and include several slow orders. As an example, a single trip may be more than a thousand kilometers and may travel through thirty or more segments with slow orders. Due to the length and duration of the trip, a slow order may have expired when the vehicle system arrives at the respective segment. If the operator is aware that the slow order has expired, the operator may break from automatic control and manually control the vehicle system through the respective segment. It is generally desirable, however, to increase the time in which the vehicle system is automatically controlled or, for those instances in which the vehicle system is controlled manually, to guide the operator along the segment using correct information. Moreover, the segment to which a slow order is applied is typically part of a much larger network of route segments that are used by numerous vehicles in a single day. Avoiding unnecessary delay caused by an expired slow order can improve the efficiency of the overall operation.

It may be desirable to have a system and method that differs from those that are currently available.

BRIEF DESCRIPTION

In one example, a control system includes a controller that may determine whether a second speed limit, which is less than or equal to a first speed limit, is in effect for a segment of the route. The controller may switch one or more operational settings of a vehicle from the first speed limit to the second speed limit, and may operate the vehicle at the first speed limit outside of the segment of the route and operate the vehicle at or below the second speed limit while the vehicle is approaching or within the segment of the route.

In another example, a method for controlling a vehicle may include determining whether a second speed limit (which is less than or equal to a first speed limit) is in effect for a segment of a route, switching one or more operational settings of a vehicle from the first speed limit to the second speed limit, and operating the vehicle at the first speed limit outside of the segment of the route and operating the vehicle at or below the second speed limit while the vehicle is on or in the segment of the route.

In another example, a system may include a controller that may dictate operational settings to be implemented by a vehicle based at least in part on a transitory second speed limit that is less than or equal to a first speed limit and which is issued for a determined segment of the route for a determined time period. The time period may have a start time and a stop time. The controller may obtain a current time as the vehicle approaches, enters, or moves through the determined segment. The controller also may determine that the transitory second speed limit has expired or will expire as the vehicle moves through the determined segment based on the current time relative to the determined time period. The controller may communicate to an off-board system information that includes at least one of: (a) a new trip plan based on a speed that exceeds the second speed limit through the route segment; (b) a new speed profile based on a speed that exceeds the second speed limit through the route segment; and/or (c) a new estimated arrival time for a subsequent point along the route that is prior to a scheduled arrival time for the point along the route. The controller may receive a new movement plan from the off-board system, the movement plan including target times-of-arrival for subsequent points along the route. The controller may dictate operational settings to be implemented by the vehicle based at least in part on the new movement plan.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
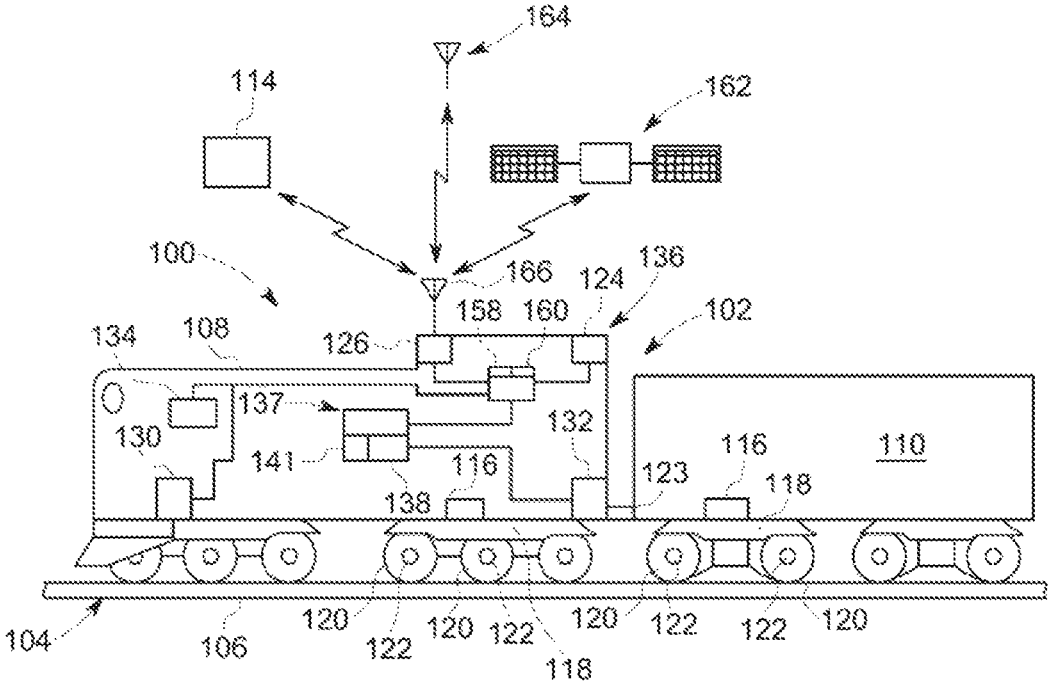
FIG. 1 is a schematic diagram of one embodiment of a control system disposed onboard a vehicle system.

Embodiments of the subject matter disclosed herein describe methods and systems used in conjunction with at least one of controlling or monitoring vehicle systems that travel along routes. Embodiments may provide methods and systems for controlling the vehicle systems along the routes after determining that a transitory speed limit has started, is in effect, or has expired based on the current time relative to a determined time period that has been issued for a segment of the route. In response to this determination, embodiments may generate a prompt to indicate that the determined time period has expired, operate the vehicle system at a new speed limit that is greater than the transitory speed limit, or modify the operational settings of the vehicle system to exceed the transitory speed limit in the determined segment but not exceed the first speed limit for the determined segment. Embodiments may modify or re-generate trip plans and/or reduce an amount of time spent manually controlling the vehicle system.

Embodiments of the subject matter described herein may also relate to systems and methods that monitor vehicle systems and the routes that the vehicle systems are traveling along. For example, embodiments may monitor switch points along the routes. Switch points are locations on a route where a vehicle system has an option to stay on a first route or change to a second route. For rail vehicles, a switch is provided at a switch point and is a physical device that moves the track between the first route and second route. In particular, embodiments may utilize or form part of a positive vehicle control (PVC) system. In the context of rail vehicle systems having interconnected vehicles, a PTC system may be one example of a PVC system. A PVC (or PTC) system may restrict movement (e.g., provide or enforce a speed limit) for certain segments along the routes, such as segments having an associated slow order or switch points where the vehicle systems moves from a first route to a second route. A negative vehicle control (NVC) system may operate in an opposite manner. The NVC system can send signals to vehicles to indicate whether those vehicles cannot enter into an upcoming segment of a route. If a vehicle does not receive a signal from the NVC system indicating that the vehicle system cannot enter into an upcoming route segment, the vehicle can proceed into or onto that route segment. Conversely, with a PVC system, the system can send a signal to a vehicle to indicate whether the vehicle can enter into the upcoming route segment. If the vehicle does not receive the signal from the PVC system indicating that the vehicle can enter into or onto the upcoming route segment, the vehicle automatically stops itself from moving into or onto the route segment.

A more particular description of the inventive subject matter briefly described above will be rendered by reference to specific embodiments thereof that are illustrated in the appended drawings. The inventive subject matter will be described and explained with the understanding that these drawings depict only typical embodiments of the inventive subject matter and are not therefore to be considered to be limiting of its scope. Wherever possible, the same reference numerals used throughout the drawings refer to the same or like parts. To the extent that the figures illustrate diagrams of the functional blocks of various embodiments, the functional blocks are not necessarily indicative of the division between hardware and/or circuitry. Thus, for example, components represented by multiple functional blocks (for example, processors, controllers, or memories) may be implemented in a single piece of hardware (for example, a general-purpose signal processor, microcontroller, random access memory, hard disk, or the like). Similarly, any programs and devices may be standalone programs and devices, may be incorporated as subroutines in an operating system, may be functions in an installed software package, or the like. The various embodiments are not limited to the arrangements and instrumentality shown in the drawings.

Not all embodiments described herein are limited to rail vehicle systems or PVC/PTC/NVC systems. For example, one or more embodiments of the systems and methods described herein can be used in connection with other types of vehicle systems, such as automobiles, trucks, buses, mining vehicles, marine vessels, aircraft, agricultural vehicles, or the like.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

As used herein, the terms "module," "system," "device," or "unit," may include a hardware and/or software system and circuitry that operate to perform one or more functions. For example, a module, unit, device, or system may include a computer processor, controller, or other logic-based device that performs operations based on instructions stored on a tangible and non-transitory computer readable storage medium, such as a computer memory. Alternatively, a module, unit, device, or system may include a hard-wired device that performs operations based on hard-wired logic and circuitry of the device. The modules, units, or systems shown in the attached figures may represent the hardware and circuitry that operates based on software or hardwired instructions, the software that directs hardware to perform the operations, or a combination thereof. The modules, systems, devices, or units can include or represent hardware circuits or circuitry that include and/or are connected with one or more processors, such as one or computer microprocessors.

As used herein, an "embedded system" is a specialized computing system that is integrated as part of a larger system, such as a larger computing system (e.g., control system) or a vehicle system. An embedded system includes a combination of hardware and software components that form a computational engine that will perform one or more specific functions. Embedded systems are unlike general computers, such as desktop computers, laptop computers, or tablet computers, which may be programmed or re-programmed to accomplish a variety of disparate tasks. Embedded systems include one or more processors (e.g., microcontroller or microprocessor) or other logic-based devices and memory (e.g., volatile and/or non-volatile) and may optionally include one or more sensors, actuators, user interfaces, analog/digital (AD), and/or digital/analog (DA) converters. An embedded system may include a clock (referred to as system clock) that is used by the embedded system for performing its intended function(s), recording data, and/or logging designated events during operation.

Embedded systems described herein include those that may be used to control a vehicle system, such as a locomotive or a consist that includes the locomotive. These embedded systems are configured to operate in time-constrained environments, such as those experienced during a trip, that require the embedded systems to make complex calculations that a human would be unable to perform in a commercially reasonable time. Embedded systems may also be reactive such that the embedded systems change the performance of one or more mechanical devices (e.g., traction motors, braking subsystems) in response to detecting an operating condition. Embedded systems may be discrete units. For example, at least some embedded systems may be purchased and/or installed into the larger system as separate or discrete units.

Non-limiting examples of embedded systems that may be used by a vehicle system, such as those described herein, include a communication management unit (CMU), a consolidated control architecture (CCA), a locomotive command and control module (LCCM), a high-performance extended applications platform (HPEAP), and an energy management system (EMS). Such embedded systems may be part of a larger system, which may be referred to as a control system. The larger system may also be the vehicle system (e.g., locomotive). In certain embodiments, the CMU is configured to communicate with an off-board system, such as a dispatch, and generate a trip plan based on input information received from the off-board system. In certain embodiments, the CCA may implement or execute the trip plan by controlling one or more traction motors and braking subsystems. The CCA may receive the trip plan from the CMU and communicate with the CMU as the vehicle system moves along the route. For example, the CMU may communicate a current time to the CCA.

As described herein, the system (e.g., the control system or the vehicle system) is configured to implement a trip plan that is based on a temporary work order that has been issued for a restricted segment of the route or to otherwise control movement of the vehicle system based on the work order (without reference to or use of a trip plan). A temporary work order can be any issued temporary order, restriction, instruction, rule, or the like that instructs or requires the vehicle system to move at or less than a designated vehicle speed limit that is different that the vehicle speed limit that is ordinarily (e.g., otherwise) applied to the restricted segment. For example, the temporary work order may be issued by a railroad or government agency and may be issued for a variety of reasons (e.g., safety of personnel working alongside the route, safety of individuals and cargo on the vehicle system, etc.). Optionally, a control system onboard one or more of the vehicle systems may issue or create the work order.

A temporary work order includes, for example, a slow order or a designated temporary work zone. In some applications, the trip plan may be implemented differently based on the type of temporary work order. For example, the trip plan may require that the vehicle system operate in a manual mode along the restricted segment for a first type of temporary work order (e.g., temporary work zone), but operate in an autonomous mode for a second type of temporary work order (e.g., slow order). Accordingly, portions of the trip plan may be implemented manually by an operator or autonomously by the vehicle system. In other embodiments, the entire trip plan is implemented autonomously by the vehicle system. The operator may interrupt automatic control, if necessary.

As used herein, a "restricted segment" refers to a segment of the route that has a temporary work order (e.g., slow order, temporary work zone) issued therefor or applied thereto. The restricted segment has a distance that is less than the entire route and, in many cases, significantly less. For example, the route for the trip may be hundreds or thousands of kilometers (km). The restricted segment, however, may be only 1-10 km. It should be understood that the length or distance of the restricted segment may be less than 1 km or more than 10 km. It should also be understood that a single trip may include more than one restricted segment. For example, a single trip may include several restricted segments (e.g., four or more restricted segments) along the route. In other embodiments, the trip may include three or fewer restricted segments.

The temporary work order specifies one or more speed limits, such as a maximum speed, for moving through the restricted segment (e.g., at most 50 km/hour (kph)). Alternatively, the speed limit specified by the work order can be a temporary speed limit that differs from the ordinary or pre-existing speed limit of the same segment of the route. For example, the segment of a route may have a speed limit that restricts vehicle systems from legally moving faster than the speed limit while traveling along or through that segment of the route. Implementation of a temporary work order may reduce this speed limit to a lower speed limit such that vehicle systems cannot legally move through the segment faster than the lower speed limit while the temporary work order is in place. Upon expiration of the work order, the lower speed limit of the segment can return to the speed limit that was in force prior to the start of the work order.

The temporary work order also specifies a beginning point (e.g., geographic location) of the restricted segment along the route and an end point (e.g., a different geographic location) of the restricted segment along the route. For example, the beginning points and end points may be identified by markers (e.g., mile markers) along the route, geographical coordinates (e.g., latitude/longitude coordinates), landmarks, route features (e.g., junctions), or other data that identifies where the restricted segment is located along the route. The maximum speed is less than a speed at which the vehicle system may typically pass along the same restricted segment when a temporary work order is not applied. For example, if the vehicle system is permitted to move at 80 kph or less when the temporary work order is not applied, the maximum speed provided by the temporary work order is less (e.g., at most 60 kph, at most 50 kph, at most 40 kph, at most 30 kph, at most 20 kph, etc.). It should be understood that units or speeds may also be expressed in miles (e.g., miles/hour).

The temporary work order may also specify a limited time period in which the temporary work order is applied or is valid for the restricted segment. The limited time period may be expressed in a designated time standard. The designated time standard may be a predetermined time standard, such as the coordinated universal time (UTC). One example of a limited time period is 13:00-18:00 UTC. Alternatively, the designated time standard may also be the local time. For example, when the restricted segment is located within the Eastern Time Zone of the United States in an area that observes standard time (autumn/winter), the designated time standard is the Eastern Standard Time (EST), which is 5 hours behind UTC. Another example of a limited time period is 1:00 pm-6:00 pm EST. Accordingly, a temporary work order issued for a restricted segment may (a) specify the beginning point and end point of the restricted segment; (b) specify the maximum speed at which the vehicle system may move through the restricted segment; and (c) specify the limited time period at which the temporary work order is valid.

Embodiments may determine a current time as the vehicle system moves along the route. As used herein, the "current time" is either expressed in the designated time standard or expressed in a different time standard that is a function of the designated time standard. For example, if the designated time standard is a regional time standard of the geographical region that includes the restricted segment (e.g., EST), the current time may be expressed in EST or in UTC, which has a known relationship with respect to EST. More specifically, UTC is five hours ahead of EST.

Temporary work orders may correspond to overlapping or non-overlapping restricted segments. For example, a temporary work order may be issued for a restricted segment that extends from a beginning point at 10 km to an end point at 12 km. Another temporary work order may be issued for a restricted segment that extends from a beginning point at 12 km to an end point at 15 km. These restricted segments are non-overlapping. As another example, a temporary work order may be issued for a restricted segment that extends from a beginning point at 15 km to an end point at 20 km. Another temporary work order may be issued for a restricted segment that extends from a beginning point at 18 km to an end point at 22 km. Such restricted segments are overlapping. In many cases, the restricted segments along a route are separate from each other. For example, a first restricted segment may extend from a beginning point at 30 km to an end point at 32 km and the next restricted segment may extend from a beginning point at 55 km to an end point at 60 km. In between these restricted segments, the vehicle system may be permitted to travel at a maximum speed that is typically applicable for the segment between the restricted segments.

Embodiments that include vehicles may be particularly suitable for routes that do or that do not include a vehicle control infrastructure, such as a PVC or NVC system. A vehicle control system may monitor the locations of numerous vehicle systems in a network of routes and communicate with the vehicle systems to prevent collisions or other unsafe traveling conditions. For example, a PTC system is configured to prevent train-to-train collisions, overspeed derailments, incursions into established work zone limits, and the movement of a train through a switch left in the wrong position. A vehicle control system may utilize wireless communication to provide control signals to a human operator of the vehicle system and to enable an onboard controller to stop the vehicle system remotely, such as in the absence of a moving authority or in an emergency. The control signals may also enable a remote dispatcher to stop the vehicle system remotely.

In particular embodiments, the vehicle control system may include a communication and signaling system that uses signals and sensors along a route to communicate a location of the vehicle system, speed restrictions, and moving authority. The moving authority may permit the vehicle system to move through the segment at a non-zero speed. If the vehicle system is violating a speed restriction or moving authority, onboard equipment may automatically slow or stop the vehicle system. Embodiments may include the controller (e.g., a controller of a vehicle control system that is disposed onboard or off-board) functioning to stop movement of the vehicle system in the absence of a moving authority. The vehicle system may be stopped with respect to a designated segment along the route, at a designated time (or time period), or for both. For example, the controller may switch the operating mode of the vehicle system from a first speed limit to a second speed limit of zero in response to determining that the vehicle system is at a designated location (e.g., within a certain distance from a work zone), is within a designated time period, and lacks moving authority. For some embodiments, the second speed limit for the segment can be defaulted to zero (fully stopped) in the absence of a determination of a non-zero first speed limit being in effect for the segment.

Embodiments may stop movement based on a location of the vehicle along a route, a designated time or time period, or both. For example, embodiments may stop movement of the vehicle prior to the vehicle entering or exiting a segment along the route. Embodiments may stop movement at a designated time or time period. The vehicle may be stopped for a designated time period or until a designated condition has occurred. In one particular example, the controller may switch the operating mode of the vehicle from a first speed limit to a second speed limit that is set to zero. Alternatively, the second speed limit may have a non-zero value. Thus, the determination of the second speed limit for the segment can be defaulted to zero (fully stopped) in the absence of a determination of a non-zero first speed being in effect for the segment.

FIG. 1 illustrates a schematic diagram of a control system 100 according to an embodiment. The control system is disposed on a vehicle system 102. The vehicle system is configured to travel on a route 104. The vehicle system is configured to travel along the route on a trip from a starting or departure location to a destination or arrival location. The vehicle system includes a propulsion-generating vehicle 108 and a non-propulsion-generating vehicle 110 that are mechanically interconnected to one another to travel together along the route. Two or more coupled propulsion-generating vehicles may form a consist or group. The vehicle system may include a single consist or multiple consists interspersed along the vehicle system. In a distributed power operation, the consist may include a lead propulsion-generating vehicle mechanically linked to one or more remote propulsion-generating vehicles, where operational settings (e.g., tractive and braking settings) of the remote propulsion-generating vehicles are controlled by the lead propulsion-generating vehicle. Alternatively, the vehicle system may be formed from a single propulsion-generating vehicle.

Optionally, the vehicle system may be formed from two or more vehicles that are not mechanically coupled with each other. Instead, these vehicles can be logically coupled with each other. The vehicles can be logically coupled by the control systems onboard the vehicles communicating with each other (e.g., using wireless communication between the vehicles) so that the vehicles can change and control the separate movements of the vehicles based on each other's movements. For example, the control systems of the vehicles communicate with each other to coordinate the movements of the vehicles so that the vehicles move together along routes without all the vehicles being directly or indirectly mechanically coupled with each other. This allows for the vehicles to travel in a convoy or platoon along the route(s) without the separate vehicles pulling and/or pushing one another along the route(s).

The propulsion-generating vehicle is configured to generate tractive efforts to propel (for example, pull and/or push) the non-propulsion-generating vehicle along the route. The propulsion-generating vehicle includes a propulsion subsystem, including one or more traction motors, that generates tractive effort to propel the vehicle system. The propulsion-generating vehicle also includes a braking subsystem that generates braking effort for the vehicle system to slow down or stop itself from moving. Optionally, the non-propulsion-generating vehicle includes a braking subsystem but not a propulsion subsystem. The propulsion-generating vehicle is referred to herein as a propulsion vehicle, and the non-propulsion-generating vehicle is referred to herein as a car. Although one propulsion vehicle and one car are shown in FIG. 1, the vehicle system may include multiple propulsion vehicles and/or multiple cars. In an alternative embodiment, the vehicle system only includes the propulsion vehicle such that the propulsion vehicle is not coupled to the car or another kind of vehicle.

The control system is used to control the movements of the vehicle system. In the illustrated embodiment, the control system is disposed entirely on the propulsion vehicle. The control system may include a plurality of embedded sub-systems, which are hereinafter referred to as embedded systems. In other embodiments, however, one or more components of the control system may be distributed among several vehicles, such as the vehicles that make up the vehicle system. For example, some components may be distributed among two or more propulsion vehicles that are coupled together in a group or consist. In an alternative embodiment, at least some of the components of the control system may be located remotely from the vehicle system, such as at a dispatch location 114. The remote components of the control system may communicate with the vehicle system (and with components of the control system disposed thereon).

In the illustrated embodiment, the vehicle system is a vehicle system, and the route is a route formed by one or more rails 106. The propulsion vehicle may be a rail vehicle (e.g., locomotive), and the car may be a rail car that carries passengers and/or cargo. The propulsion vehicle may be another type of vehicle other than a locomotive. In another embodiment, the propulsion-generating vehicles may be trucks and/or automobiles configured to drive on a route composed of pavement (e.g., a highway). The vehicle system may be a group or consist of trucks and/or automobiles that are logically coupled to coordinate movement of the vehicles along the pavement. In other embodiments, the vehicles may be off-highway vehicles (e.g., mining vehicles and other vehicles that are not designed for or permitted to travel on public roadways) traveling on a route of earth, marine vessels traveling on a route of water (e.g., a water route, such as a shipping route), aerial vehicles traveling on a route of air (e.g., an airborne path), or the like. Thus, although some embodiments of the inventive subject matter may be described herein with respect to trains, locomotives, and other vehicles, embodiments of the inventive subject matter also are applicable for use with vehicles generally.

The vehicles of the vehicle system each include multiple wheels 120 that engage the route and at least one axle 122 that couples left and right wheels together (only the left wheels are shown in FIG. 1). Optionally, the wheels and axles are located on one or more trucks or bogies 118. Optionally, the trucks may be fixed-axle trucks, such that the wheels are rotationally fixed to the axles, so the left wheel rotates the same speed, amount, and at the same times as the right wheel. The propulsion vehicle is mechanically coupled to the car by a coupler 123. The coupler may have a draft gear configured to absorb compression and tension forces to reduce slack between the vehicles. Although not shown in FIG. 1, the propulsion vehicle may have a coupler located at a front end 125 of the propulsion vehicle and/or the car may have a coupler located at a rear end 127 of the car for mechanically coupling the respective vehicles to additional vehicles in the vehicle system. Alternatively, the vehicle may not have any coupler for connecting with another vehicle.

As the vehicle system travels along the route during a trip, the control system may be configured to measure, record, or otherwise receive and collect input information about the route, the vehicle system, and the movement of the vehicle system on the route. For example, the control system may be configured to monitor a location of the vehicle system along the route and a speed at which the vehicle system moves along the route, which is hereinafter referred to as a vehicle speed.

Additionally, the control system may be configured to generate a trip plan and/or a control signal based on such input information. The trip plan and/or control signal designates one or more operational settings for the vehicle system to implement or execute during the trip as a function of time, location, and/or distance along the route. The operational settings may include tractive settings, braking settings, speeds, etc., for the vehicle system. For example, the operational settings may include dictated speeds, throttle settings, brake settings, accelerations, or the like, of the vehicle system as a function of time, location, and/or distance along the route traversed by the vehicle system.

The trip plan is configured to achieve or increase specific goals or objectives during the trip of the vehicle system, while meeting or abiding by designated constraints, restrictions, and limitations. Some possible objectives include increasing energy (e.g., fuel) efficiency, reducing emissions generation, reducing trip duration, increasing fine motor control, reducing wheel and route wear, and the like. The constraints or limitations include speed limits, schedules (such as arrival times at various designated locations), environmental regulations, standards, and the like. The operational settings of the trip plan are configured to increase the level of attainment of the specified objectives relative to the vehicle system traveling along the route for the trip according to operational settings that differ from the one or more operational settings of the trip plan (e.g., such as if the human operator of the vehicle system determines the tractive and brake settings for the trip). One example of an objective of the trip plan is to increase fuel efficiency (e.g., by reducing fuel consumption) during the trip. By implementing the operational settings designated by the trip plan, the fuel consumed may be reduced relative to travel of the same vehicle system along the same segment of the route in the same time period but not according to the trip plan.

The trip plan may be established using an algorithm based on models for vehicle behavior for the vehicle system along the route. The algorithm may include a series of non-linear differential equations derived from applicable physics equations with simplifying assumptions, such as described in connection with U.S. Pat. No. 8,655,516, the entire disclosure of which is incorporated herein by reference.

In one embodiment, the control system uses information received from the vehicle control system to create and/or modify a trip plan. For example, the PTC system may inform the control system of a work order, the presence of another vehicle system on an upcoming route segment, or the like. Based on this information, the control system may be forced by the vehicle control system to reduce the speed of the vehicle system and/or stop movement of the vehicle system. The control system can modify and/or create the trip plan using this vehicle control system information. For example, automatically slowing the vehicle system due to the vehicle control system may require the control system to modify an existing trip plan. The control system can change the trip plan to make up for lost time due to the unplanned need to slow down from the vehicle control system.

The control system may be configured to control the vehicle system along the trip based on the trip plan, such that the vehicle system travels according to the trip plan. In a closed loop mode or configuration, the control system may autonomously control or implement propulsion and braking subsystems of the vehicle system consistent with the trip plan, without requiring the input of a human operator. In an open loop coaching mode, the operator is involved in the control of the vehicle system according to the trip plan. For example, the control system may present or display the operational settings of the trip plan to the operator as directions on how to control the vehicle system to follow the trip plan. The operator may then control the vehicle system in response to the directions. As an example, the control system may be or include a Trip Optimizer™ system from Westinghouse Air Brake Technologies Corporation, or another energy management system.

Alternatively, the control system may control the vehicle system outside of a pre-planned trip and/or without use of a trip plan. For example, the control system can receive manual inputs from the operator and change throttle settings, brake settings, speeds, etc., accordingly based on the manual inputs. As another example, the control system can receive sensor inputs of the moving speed of the vehicle system, the presence (or absence) of other vehicles or objects on the same route and/or within a designated distance of the vehicle system, weather conditions, time-of-day, work orders, or the like, and automatically control movement of the vehicle system based on the sensor inputs.

The control system may include at least on embedded system. In the illustrated embodiment, the control system includes a first embedded system 136 and a second embedded system 137 that are communicatively coupled to each other. Although the control system is shown as having only two embedded systems, it should be understood that the control system may have more than two embedded systems. In certain embodiments, the first embedded system may be a CMU and the second embedded system may be a CCA.

The first embedded system includes one or more processors 158 and memory 160. The one or more processors may generate a trip plan based on input information received from the second embedded system or other components of the vehicle system and/or input information received from a remote location. As used herein, a trip plan is "generated" when an entire trip plan is created (e.g., a new trip plan is created) or an existing plan is modified based on, for example, recently received input information. For example, a new trip plan may be generated after determining that a temporary work order is no longer valid. The new trip plan may be based on the trip plan that the vehicle system was implementing prior to determining that the temporary work order is no longer valid.

The first embedded system may be configured to communicatively couple to a wireless communication system 126. The wireless communication system includes an antenna 166 and associated circuitry that enables wireless communications with global navigation satellite system (GNSS) satellites 162 (e.g., global positioning system or GPS satellites), a remote (dispatch) location, and/or a cell tower 164. For example, first embedded system may include a port (not shown) that engages a respective connector that communicatively couples the one or more processors and/or memory to the wireless communication system. Alternatively, the first embedded system may include the wireless communication system. The wireless communication system may also include a receiver and a transmitter, or a transceiver that performs both receiving and transmitting functions.

Optionally, the first embedded system is configured to communicatively couple to or includes a locator device 124. The locator device is configured to determine a location of the vehicle system on the route. The locator device may be a GNSS or GPS receiver. In such embodiments, one or more components of the locator device may be shared with the wireless communication system. Alternatively, the locator device may include a system of sensors including wayside devices (e.g., including radio frequency automatic equipment identification (RF AEI) tags), video or image acquisition devices, or the like. The locator device may provide a location parameter to the one or more processors, where the location parameter is associated with a current location of the vehicle system. The location parameter may be communicated to the one or more processors periodically or upon receiving a request. The one or more processors may use the location of the vehicle system to determine the proximity of the vehicle system to one or more designated locations of the trip. For example, the designated locations may include points along the route that are proximate to restricted segments or within the restricted segments. The designated locations may also include an arrival location at the end of the trip, a passing loop location along the route where another vehicle system on the route is scheduled to pass the vehicle system, a break location for re-fueling, crew change, passenger change, or cargo change, and the like.

Also shown, the second embedded system includes one or more processors 138 and memory 141. Optionally, the second embedded system is configured to communicatively couple to multiple sensors 116, 132. For example, the second embedded system may include ports (not shown) that engage respective connectors that are operably coupled to the sensors. Alternatively, the second embedded system may include the sensors.

The multiple sensors are configured to monitor operating conditions of the vehicle system during movement of the vehicle system along the route. The multiple sensors may monitor data that is communicated to the one or more processors of second embedded system for processing and analyzing the data. For example, the sensor may be a speed sensor that is disposed on the vehicle system. In the illustrated embodiment, the speed sensors are located on or near the trucks. Each speed sensor is configured to monitor a speed of the vehicle system as the vehicle system traverses the route. The speed sensor may be a speedometer, a vehicle speed sensor (VSS), tachometer, global positioning system receiver, dead reckoning system, or the like. The speed sensor may provide a speed parameter to the one or more processors, where the speed parameter is associated with a current speed of the vehicle system. The speed parameter may be communicated to the one or more processors periodically, such as once every second or every two seconds, or upon receiving a request for the speed parameter.

The sensors may measure other operating conditions or parameters of the vehicle system during the trip (e.g., besides or in addition to speed and/or location). The sensors may include throttle and brake position sensors that monitor the positions of manually-operated throttle and brake controls, respectively, and communicate control signals to the respective propulsion and braking subsystems. The sensors may also include sensors that monitor power output by the motors of the propulsion subsystem and the brakes of the braking subsystem to determine the current tractive and braking efforts of the vehicle system. Furthermore, the sensors may include string potentiometers (referred to herein as string pots) between at least some of the vehicles of the vehicle system, such as on or proximate to the couplers. The string pots may monitor a relative distance and/or a longitudinal force between two vehicles. For example, the couplers between two vehicles may allow for some free movement or slack of one of the vehicles before the force is exerted on the other vehicle. As the one vehicle moves, longitudinal compression and tension forces shorten and lengthen the distance between the two vehicles like a spring. The string pots are used to monitor the slack between the vehicles of the vehicle system. The above represents a short list of possible sensors that may be on the vehicle system and used by the second embedded system (or the control system more generally), and it is recognized that the second embedded system and/or the control system may include more sensors, fewer sensors, and/or different sensors.

Other sensors can include a communication device that receives weather conditions from an external source (e.g., a weather reporting service). For example, a wireless transceiver can receive reports of weather conditions. A light sensor can measure the amount of light outside the vehicle (which can indicate reduced visibility, such as during foggy weather).

In an embodiment, the control system includes a vehicle characterization element that provides information about the vehicle system. The vehicle characterization element provides information about the make-up of the vehicle system, such as the type of cars (for example, the manufacturer, model, the product number, the materials, etc.), the number of cars, the weight of cars, whether the cars are consistent (meaning relatively identical in weight and distribution throughout the length of the vehicle system) or inconsistent, the type and weight of cargo (e.g., liquid versus solid, persons versus materials, perishable versus non-perishable, hazardous versus non-hazardous, etc.), the total weight of the vehicle system, the number of propulsion vehicles, the position and arrangement of propulsion vehicles relative to the cars, the type of propulsion vehicles (including the manufacturer, the product number, power output capabilities, available notch settings, fuel usage rates, etc.), and the like. The vehicle characterization element may be a database stored in an electronic storage device, or memory. The information in the vehicle characterization element may be input using an input/output (I/O) device (referred to as a user interface device) by an operator, may be automatically uploaded, or may be received remotely via the communication system. The source for at least some of the information in the vehicle characterization element may be a vehicle manifest, a log, or the like.

The control system further includes a trip characterization element 130. The trip characterization element is configured to provide information about the trip of the vehicle system along the route. The trip information may include route characteristics, designated locations, designated stopping locations, schedule times, meet-up events, directions along the route, and the like. For example, the designated route characteristics may include grade, elevation slow warnings, environmental conditions (e.g., rain and snow), and curvature information. The designated locations may include the locations of wayside devices, passing loops, re-fueling stations, passenger, crew, and/or cargo changing stations, and the starting and destination locations for the trip. At least some of the designated locations may be designated stopping locations where the vehicle system is scheduled to come to a complete stop for a period of time. For example, a passenger changing station may be a designated stopping location, while a wayside device may be a designated location that is not a stopping location. The wayside device may be used to check on the on-time status of the vehicle system by comparing the actual time at which the vehicle system passes the designated wayside device along the route to a projected time for the vehicle system to pass the wayside device according to the trip plan. The trip information concerning schedule times may include departure times and arrival times for the overall trip, times for reaching designated locations, and/or arrival times, break times (e.g., the time that the vehicle system is stopped), and departure times at various designated stopping locations during the trip. The meet-up events include locations of passing loops and timing information for passing, or getting passed by, another vehicle system on the same route. The directions along the route are directions used to traverse the route to reach the destination or arrival location. The directions may be updated to provide a path around a congested area or a construction or maintenance area of the route. The trip characterization element may be a database stored in an electronic storage device, or memory. The information in the trip characterization element may be input via the user interface device by an operator, may be automatically uploaded, or may be received remotely via the communication system. The source for at least some of the information in the trip characterization element may be a trip manifest, a log, or the like.

The first embedded system is a hardware and/or software system that is communicatively coupled to or includes the trip characterization element and the vehicle characterization element. The first embedded system may also be communicatively coupled to the second embedded system and/or individual components of the second embedded system, such as the sensors. The one or more processors receives input information from components of the control system and/or from remote locations, analyzes the received input information, and generates operational settings for the vehicle system to control the movements of the vehicle system. The operational settings may be contained in a trip plan. The one or more processors may have access to, or receives information from, the speed sensor, the locator device, the vehicle characterization element, the trip characterization element, and at least some of the other sensors on the vehicle system. The first embedded system may be a device that includes a housing with the one or more processors therein (e.g., within a housing). At least one algorithm operates within the one or more processors. For example, the one or more processors may operate according to one or more algorithms to generate a trip plan.

By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. Memory, such as the memory, can include a tangible, non-transitory computer-readable storage medium that stores data on a temporary or permanent basis for use by the one or more processors. The memory may include one or more volatile and/or non-volatile memory devices, such as random-access memory (RAM), static random-access memory (SRAM), dynamic RAM (DRAM), another type of RAM, read only memory (ROM), flash memory, magnetic storage devices (e.g., hard discs, floppy discs, or magnetic tapes), optical discs, and the like.

In an embodiment, using the information received from the speed sensor, the locator device, the vehicle characterization element, trip characterization element, and/or other sensors, the first embedded system is configured to designate one or more operational settings for the vehicle system as a function of time and/or distance along the route during a trip. The one or more operational settings are designated to drive or control the movements of the vehicle system during the trip toward achievement of one or more objectives for the trip.

The operational settings may be one or more of speeds, throttle settings, brake settings, or accelerations for the vehicle system to implement during the trip. Optionally, the one or more processors may be configured to communicate at least some of the operational settings designated by the trip plan. The control signal may be directed to the propulsion subsystem, the braking subsystem, or a user interface device of the vehicle system. For example, the control signal may be directed to the propulsion subsystem and may include notch throttle settings of a traction motor for the propulsion subsystem to implement autonomously upon receipt of the control signal. In another example, the control signal may be directed to a user interface device that displays and/or otherwise presents information to a human operator of the vehicle system. The control signal to the user interface device may include throttle settings for a throttle that controls the propulsion subsystem, for example. The control signal may also include data for displaying the throttle settings visually on a display of the user interface device and/or for alerting the operator audibly using a speaker of the user interface device. The throttle settings optionally may be presented as a suggestion to the operator, for the operator to decide whether or not to implement the suggested throttle settings.

At least one technical effect of various examples of the inventive subject matter described herein may include an increased amount of automatic control time in which the human operator of the vehicle system does not manually control the vehicle system. Another technical effect may include generating, upon determining that a temporary work order is invalid, a new trip plan that is configured to have at least one of (a) a predicted trip duration that is essentially equal to the predicted trip duration of a prior trip plan or (b) a predicted fuel consumption that is less than the first predicted fuel consumption of the prior trip plan. Another technical effect may be providing information to the human operator for guiding the human operator for manually controlling the vehicle system through a restricted segment (or segment that is no longer associated with a temporary work order).

Figure 2:
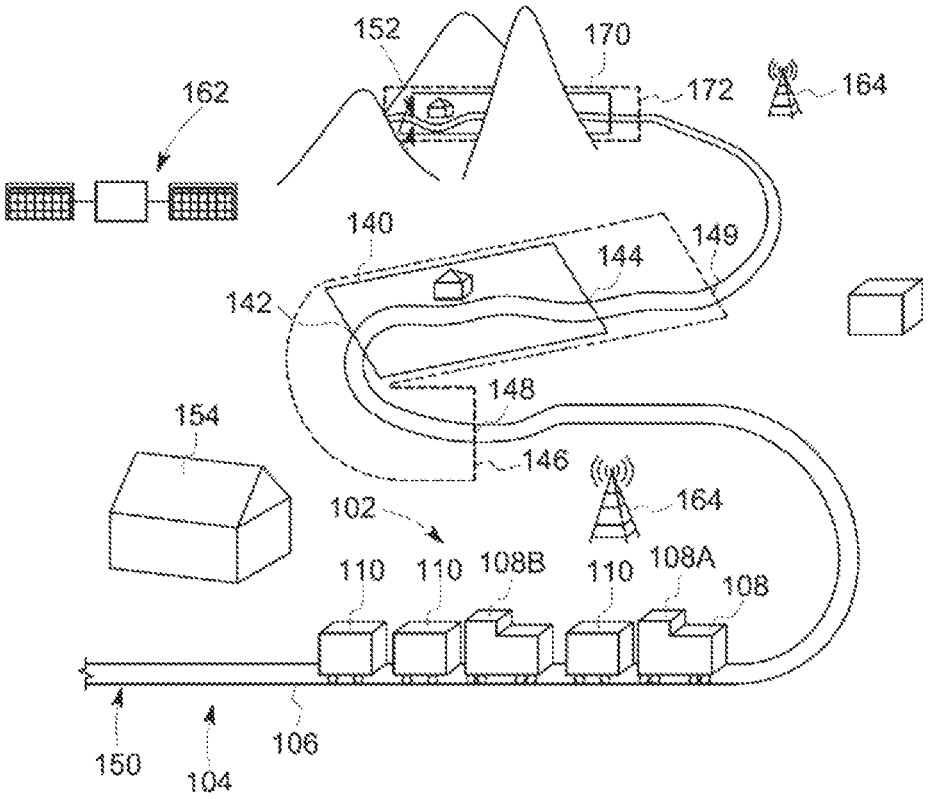
FIG. 2 is an illustration of a vehicle system traveling along a route in accordance with an embodiment.

FIG. 2 is an illustration of the vehicle system traveling along the route in accordance with an embodiment. As described above with respect to FIG. 1, the vehicle system includes propulsion-generating vehicles and three non-propulsion-generating vehicles. At least one of the propulsion-generating vehicles includes the control system (FIG. 1). The route extends from a starting location 150 to a final destination location 152. The vehicle system starts a trip along the route at the starting location and completes the trip at the final destination location. For example, the starting location may be at or near a port, and the final destination location may be at or near a mine, such as when the vehicle system is set to travel from the port to the mine to receive a load of cargo at the mine to be transported back to the port. The trip may be, for example, tens, hundreds, or thousands of kilometers (or miles). A trip duration that is measured from the starting location to the destination location may be minutes or hours (e.g., 6 hours, 8 hours, 10 hours, 12 hours, or more).

In some embodiments, a trip represents the journey between a point at which the vehicle system begins moving and a point at which the vehicle system stops moving. In some embodiments, the trip includes all the travel that a vehicle system accomplishes in a single day. In other embodiments, however, a trip may only be one of multiple trips that are traveled in a single day by a vehicle system. For example, a vehicle system may make three six-hour trips in a single day or four four-hour trips in a single day. As such, the term "trip" may be a portion of a longer trip or journey. The trip may be a pre-planned trip (where the starting location, end location, and routes to travel on from the starting location to the end location are known and previously identified before reaching the routes and/or end location). Alternatively, the trip may not be a pre-planned trip such that the routes to be traveled upon and/or end location are not known or set before embarking on the trip.

The vehicle system may communicate wirelessly with an off-board system 154, the GPS satellites 162, and/or cell towers 164. Prior to the vehicle system departing for the trip and/or as the vehicle system moves along the route, the vehicle system may be configured to communicate with the off-board system. The off-board system may be configured to receive a request for trip data from the vehicle system, interpret and process the request, and transmit input information back to the vehicle system in a response. The input information (or trip data) may include trip information, vehicle information, route information, and the like that may be used by the vehicle system to generate a trip plan. As described above, the trip plan may be generated by the first embedded system (FIG. 1). In other embodiments, the trip plan is generated by the control system generally using, for example, one or more embedded systems. Yet in other embodiments, the trip plan may be generated by the off-board system. Prior to the vehicle system departing for the trip, the vehicle system may also communicate with the GPS satellites and/or the cell towers.

Vehicle information includes vehicle makeup information of the vehicle system, such as model numbers, manufacturers, horsepower, number of vehicles, vehicle weight, and the like, and cargo being carried by the vehicle system, such as the type and amount of cargo carried. Trip information includes information about the upcoming trip, such as starting and ending locations, station information, restriction information (such as identification of work zones along the trip and associated speed/throttle limitations), and/or operating mode information (such identification of speed limits and slow orders along the trip and associated speed/throttle limitations). Route information includes information about the route along the trip, such as locations of damaged sections, sections under repair or construction, the curvature and/or grade of the route, global positioning system (GPS) coordinates of the trip, weather reports of weather experienced or to be experienced along the trip, and the like. The input information may be communicated to the vehicle system prior to the vehicle system departing from the starting location. The input information may also be communicated to the vehicle system after the vehicle system has departed from the starting location.

The input information may also include a temporary work order, if one exists, that designates a restricted segment of the route (e.g., the beginning point and the end point of the segment), a speed limit through which the vehicle system may travel through the restricted segment, and a limited time period in which the temporary work order is applied (e.g., 8:00 am-2:00 pm EST) to the restricted segment. As described above, the speed limit associated with the work order can be different than the speed limit associated with the same segment of the route before the work order was implemented.

As the vehicle system moves along the route, the vehicle system may communicate with other wireless communication systems. For example, the vehicle system may communicate with the GPS satellites and/or the cell towers. The GPS satellites may provide location information, such as latitude and longitude coordinates, that can be used to identify the location of the vehicle system along the route. The GPS satellites may also provide time information. For instance, the GPS satellites may communicate a present time to the vehicle system that is expressed in a predetermined time standard (e.g., UTC). The cell towers may provide location information and/or time information. For example, the cell towers may communicate the present time based on the predetermined time standard or based on a regional time standard of the geographical region in which the vehicle system is presently located. The cell towers may also provide location information that can be used to identify where the vehicle system is located within the geographical region. In some embodiments, the vehicle system may uses information from GPS satellites and information from cell towers.

As illustrated in FIG. 2, the route includes a restricted segment 140. For example, the input information used to generate the trip plan included a temporary work order that specified a beginning point 142 and an end point 144 of the restricted segment. The temporary work order may be issued by, for example, a government agency or railroad that communicates with the off-board system. The temporary work order also includes a maximum speed that is permitted to travel through the restricted segment and a limited time period in which the temporary work order is active or valid.

The trip plan generated by the vehicle system (or the off-board system) may also specify a monitoring segment 146. The monitoring segment may represent a portion of the route that includes the restricted segment. The monitoring segment is greater or longer than the restricted segment. While moving through the monitoring segment, the vehicle system may determine whether the temporary work order has expired. For example, the monitoring segment includes a beginning point 148 and an end point 149. As the vehicle system moves through the monitoring segment between the beginning and end points, the vehicle system may continuously or periodically determine a current time that is based, at least in part, on communications with GPS satellites 162 and/or the cell towers 164. The vehicle system may then determine whether the temporary work order has expired based on the current time and the limited time period. In some embodiments, the vehicle system determines a location of the vehicle system along the route and then determines the current time based on the location.

Yet in other embodiments, the trip plan does not identify a monitoring segment 146 or a beginning point 148. In such embodiments, the vehicle system may continuously or periodically (e.g., every second or every minute) determine the current time and determine whether any upcoming restricted segments or restricted segments that the vehicle system is presently moving through have expired. For example, the trip plan may specify twenty temporary work orders for the trip. The vehicle system (e.g., the control system or the first embedded system) may determine, for each of the temporary work orders in the trip plan or for each of the temporary work orders in an upcoming series of work orders (e.g., the next five restricted segments or all restricted segments within the next one hundred kilometers), whether the respective temporary work order has expired. If one or more of the temporary work orders have expired, the vehicle system may generate another trip plan that removes speed restrictions for the restricted segment(s) associated with the expired work order(s). In some embodiments, the vehicle system may communicate with the off-board system to request updated input information prior to generating the other trip plan. In other embodiments, the vehicle system may generate a new trip plan without receiving updated input information from the off-board system.

In some embodiments, the vehicle system (or the control system) may modify the operational settings of the trip plan such that the vehicle system exceeds the maximum speed through the restricted segment. In such embodiments, the step of modifying the operational settings may occur prior to or as a new trip plan is generated. The step of modifying may include increasing the vehicle speed to a vehicle speed that is equal to or less than the speed limit when the temporary work order is not applied. For example, if the vehicle speed limit is 60 kph when the temporary work order is not applied, but 30 kph when the temporary work order is applied, the vehicle system may increase the vehicle speed from 30 kph to 60 kph after determining that the temporary work order has expired. The vehicle system may generate a new trip plan as the vehicle system increases the vehicle speed or after the vehicle system increases the vehicle speed.

As used in the detailed description and the claims, a trip plan may be generated before or after departure. During the trip, one or more new trip plans may be generated. When a new trip plan is implemented, the new trip plan becomes the existing trip plan or current trip plan and the next trip plan that is generated may be referred to as the new trip plan. For example, a new trip plan may be, numerically, the tenth trip plan generated by the vehicle system during the trip between the starting location and the final destination location. In this example, the ninth trip plan would be the "existing trip plan" or "current trip plan."

Also shown in FIG. 2, the route includes another restricted segment 170 and monitoring segment 172. As described herein, the route may include several restricted segments and, optionally, monitoring segments. The trip plan may be configured to control the vehicle system so that the vehicle system does not exceed the maximum speed through the restricted segment. However, due to delays along the trip, the temporary work order issued for the restricted segment may expire prior to the vehicle system entering the restricted segment or as the vehicle segment moves through the restricted segment. Alternatively, due to the expiration of a temporary work order or temporary work orders, the vehicle system may arrive at the restricted segment sooner than predicted such that temporary work order for the restricted segment is still valid. In such embodiments, the new trip plan may be configured to decrease the vehicle speed through the restricted segment in order to satisfy the temporary work order.

Figure 3:
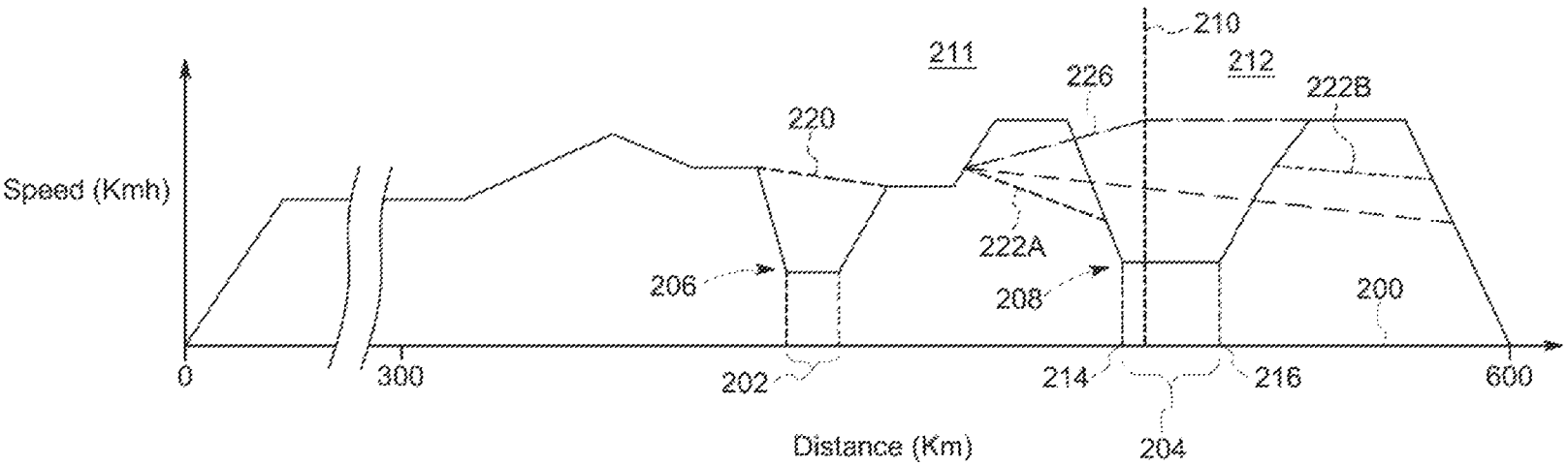
FIG. 3 illustrates a predicted speed profile of a trip and possible modifications to the speed profile based on when a slow order expires.
Figure 4:
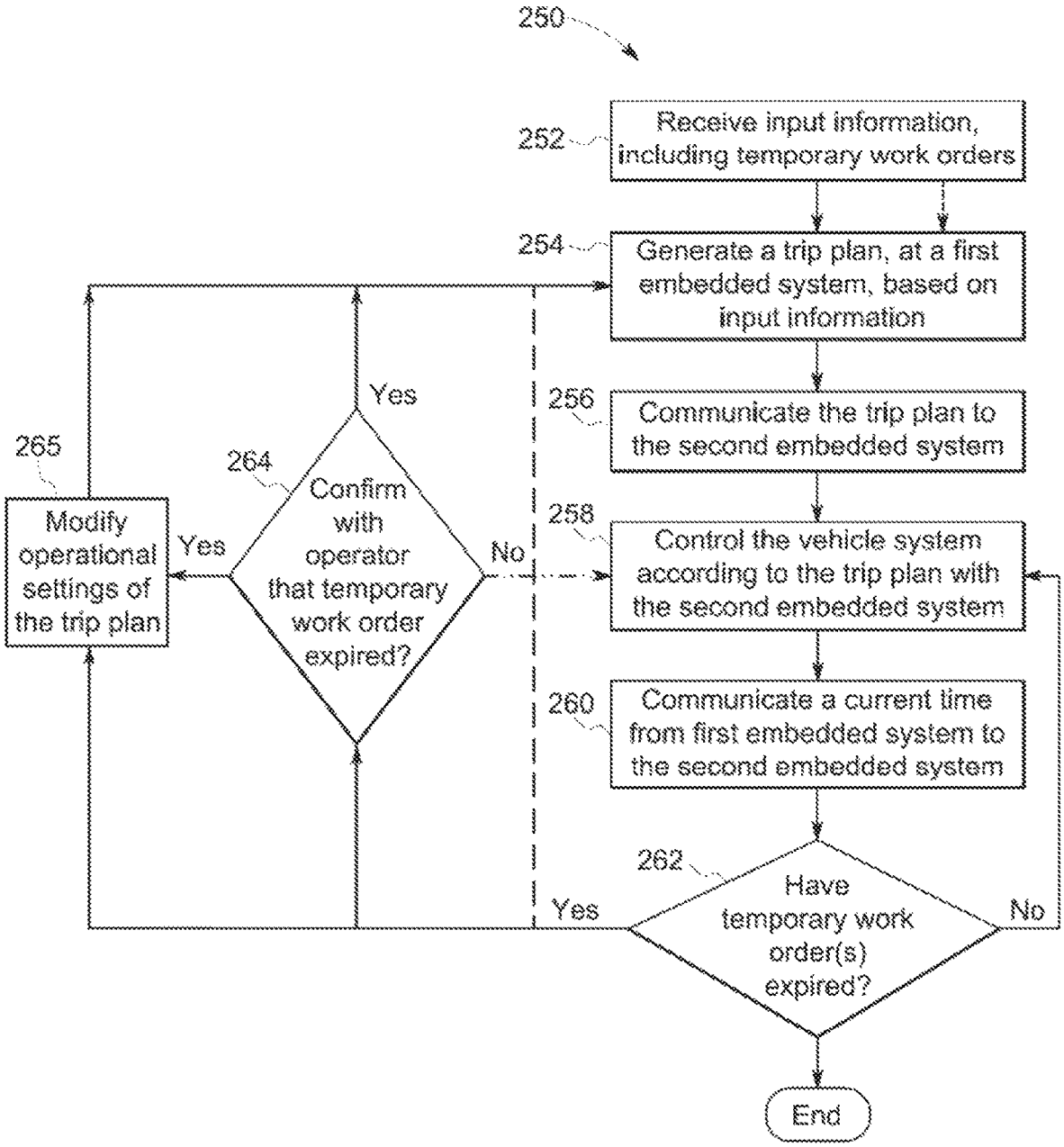
FIG. 4 is a flow chart illustrating a method (e.g., of operating a vehicle system) in accordance with an embodiment.

FIG. 3 illustrates a predicted speed profile (in solid lines) when a vehicle system begins a trip and possible changes to the speed profile (dashed lines) that may occur due to one or more temporary work orders expiring. The predicted speed profile may be determined by or based on the trip plan(s) that are generated for the route. FIG. 4 is a flow chart illustrating a method 250 (e.g., of operating a vehicle system) that is described with respect to the speed profile of FIG. 3. For illustrative purposes, FIG. 3 primarily shows the second half of the route between 300 km and 600 km. It should be understood, however, that the method may be used throughout the route.

The horizontal axis in FIG. 3 between 0 km and 600 km represents a route. The route includes restricted segments 202 and 204, but other restricted segments may exist in the first half of the route. Each of the restricted segments is associated with a temporary work order that specifies a maximum speed of a vehicle system moving through the restricted segment. The maximum speeds of the restricted segments are indicated at 206, 208, respectively. The vehicle system would be permitted to move through the restricted segments at greater vehicle speed if the temporary work orders did not exist or were expired. For example, the vehicle speed permitted when the temporary work order expires may be at least 1.5 times (1.5×) or at least 2 times (2×) the maximum speed specified by the temporary work order.

With respect to FIGS. 3 and 4, the method may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

The method is described as utilizing a first embedded system and a second embedded system. The first embedded system and the second embedded system may be separate embedded systems that are components of the same vehicle system. For example, the first and second embedded systems may be components of the same locomotive. Each of the first and second embedded systems may communicate with different components. Alternatively, the first and second embedded systems may communicate with at least one common component (e.g., wireless communication system or designated sensor). As one example, the first embedded system is a CMU and the second embedded system is a CCA.

Each of the first and second embedded systems may have a respective system clock that is independent of a time standard and also independent from each other. For example, the system clocks may be based on when the respective embedded system is started (e.g., booted or initialized). It is contemplated that the system clocks may be essentially synchronized by simultaneously starting the first and second embedded systems at the same time. The system clocks may also be synchronized by communicating with each other and modifying the time of at least one of the system clocks so that the two system clocks are essentially synchronized.

Each of the first and second embedded systems may utilize their respective system clock during operation. For example, the first embedded system may record data and/or log events in a recorder in which the times logged are determined by the system clock of the first embedded system. Likewise, the second embedded system may utilize its system clock while implementing the trip plan and/or other functions of the second embedded system.

The method includes receiving, at 252, input information for generating a trip plan. The input information may include data for generating a trip plan, such as those described above, and one or more temporary work orders. The input information may be received from a single source, such as a single off-board system, or from multiple sources. In addition to the off-board system, the sources may include an onboard component of the vehicle system. For example, the source may be a database that provides vehicle information (e.g., weight, number of cars) or a sensor that provides information on an operating condition. In an exemplary embodiment, the input information may be received by the first embedded system or, more generally, the control system. In other embodiments, however, the off-board system may receive the input information to generate the trip plan remotely.

At 254, a trip plan may be generated that is based on (or a function of) the input information, including the temporary work orders. The trip plan may be generated prior to departure. The trip plan, however, may also be generated after departure. In an exemplary embodiment, the trip plan is generated by the first embedded system. More specifically, the first embedded system may analyze the input information and use one or more algorithms to generate a trip plan. The trip plan dictates or provides tractive settings and braking settings to be implemented by the vehicle system moving along the route. In addition to the settings, the trip plan may include at least one of a predicted speed profile, a predicted trip duration, a predicted arrival time at the final destination, a predicted fuel consumption, or predicted fuel emissions (e.g., for the entire route or for a portion of the route that remains after a designated point along the route). Alternatively, the trip plan may include information that is sufficient for calculating the predicted speed profile, the predicted trip duration, the predicted arrival time at the final destination, the predicted fuel consumption, and/or the predicted fuel emissions. The predicted speed profile may be similar or identical to the predicted speed profile shown in FIG. 3.

As described above, the trip plan may also be based on one or more temporary work orders issued for restricted segments along the route, such as the restricted segments. The trip plan may be based on ten, twenty, thirty, or more temporary work orders in which each temporary work order provides a maximum speed through the restricted segment and a limited time period in which the maximum speed restriction is implemented. The limited time period may be expressed using a designated time standard. The designated time standard may be, for example, UTC or a regional time standard of the geographical region that includes the restricted segment.

The trip plan may be based on temporary work orders that are located in different time zones. In some cases, a temporary work order may correspond to a restricted segment that extends through a boundary between two different time zones. For example, a line 210 is shown in FIG. 3 that indicates a boundary between first and second time zones 211, 212. The restricted segment extends through each of the first and second time zones such that portions of the restricted segment are located in different time zones. More specifically, a beginning point 214 of the restricted segment is located within the first time zone, and an end point 216 of the restricted segment is located within the second time zone. As such, in some embodiments, the trip plan includes limited time periods that are expressed in different time standards (e.g., EST, central time standard (CST), mountain standard time (MST), etc.). Although the examples provided are in the United States, it should be understood that the restricted segments may exist in other countries that use different time standards.

After generating the trip plan the trip plan may be communicated, at 256, to the vehicle system or the control system. If the trip plan was generated by the vehicle system, the trip plan may be communicated to the designated embedded system (e.g., the second embedded system). Optionally, the system that generates the trip plan may also control operation of the vehicle system in accordance with the trip plan. In such alternative embodiments, the step of communicating the trip plan is not necessary to perform.

The vehicle system is controlled, at 258, according to the trip plan. In particular embodiments, the second embedded system receives the trip plan from the first embedded system and implements the trip plan by, at least in part, controlling operation of traction motors and braking subsystems.

At 260, a current time may be communicated to the system (e.g., control system or second embedded system) that is controlling the vehicle system. In the illustrated embodiment, the current time is communicated from the first embedded system to the second embedded system. In some embodiments, the current time may be communicated only upon request from the system that is controlling the vehicle system. In other embodiments, the current time may be continuously or periodically sent by the first embedded system without a request from the second embedded system.

The current time may be expressed in a designated time standard (e.g., UTC) or expressed in a regional time standard of the geographical region that includes the restricted segment. For embodiments in which the current time is expressed in the regional time standard, the current time is referred to as the local time. As one example, the first embedded system may communicate that the current time is 13:25 UTC or, alternatively, the first embedded system may communicate that the local time is 10:25 EST (if the regional time standard is EST).

For embodiments in which the current time is expressed in the regional time standard, the current time may be converted into the regional time standard by the control system. In particular embodiments, the current time is converted into the regional time standard by the first embedded system. For example, the first embedded system may be configured to communicate wirelessly with a remote system, such as a GPS satellite or a cell tower. The first embedded system may receive time data and location data from the remote system. The time data may correspond to the current time in the designated time standard (or other known time standard). The first embedded system may continuously or periodically (e.g., every second, every five seconds, every ten seconds, etc.) receive time data and location data from the remote system. Alternatively, the first embedded system may request the time data and location data from the remote system at designated events, such as receiving a request for the current time from the second embedded system.

As such, the current time may be communicated from the remote system to the first embedded system. The location data may be used to identify where the vehicle system is located at the current time. For example, the GPS satellite may communicate current time and latitude and longitude coordinates to the first embedded system. The first embedded system may include a database that defines a path of the route in latitude and longitude coordinates. The first embedded system may compare the latitude and longitude coordinates from the GPS satellite to the latitude and longitude coordinates in the database to identify a location of the vehicle system at the current time. This location may be referred to as the current location or present location.

Using the current location, the first embedded system may be configured to determine a regional time standard of the geographical region that includes the restricted segment. With the current time known in the designated time standard (e.g., UTC), the first embedded system may convert the current time in the designated time standard to a current time (or local time) in the regional time standard. The local time may be communicated from the first embedded system to the second embedded system. As described below, the second embedded system (or the control system) may use the local time to determine if a temporary work order has expired.

Yet in other embodiments, the system that is controlling operation of the vehicle system may communicate directly with the remote system. For example, the second embedded system may be configured to communicate with a GPS satellite and/or cell tower to determine the current time and location of the vehicle system. The second embedded system may then convert the current time into a local time, if necessary, using the process described above with respect to the first embedded system.

The current time may be communicated to the second embedded system as the vehicle system approaches a restricted segment or as the vehicle system moves through the restricted segment. For example, it may be possible that a temporary work order expires while the vehicle system is located within the restricted segment. In some embodiments, the current time is continuously or periodically received by the second embedded system (or the control system). In other embodiments, the second embedded system may request the current time from the first embedded system at a designated point along the route. For example, the trip plan may identify when to request the current time from the first embedded system.

In some embodiments, the second embedded system may maintain a current clock in addition to the system clock. The current clock may have a time that is kept by the second embedded system and that is based on a previously-determined offset with respect to the system clock of the second embedded system. Such embodiments may be useful when vehicle systems are located in dead zones where wireless communication with remote system has failed or is not reliable. More specifically, prior to arriving at a restricted segment, the second embedded system may receive a current time. The second embedded system may determine that system clock is offset with respect to the current time by a designated value. The designated value may be, for example, in seconds or minutes. With the offset known, the second embedded system may be able to determine a current time. Similar to above, it may be necessary to modify the offset when crossing multiple time zones.

At 262, the second embedded system (or the control system) may query whether the temporary work order of an approaching restricted segment has expired or whether the temporary work orders of approaching restricted segments have expired. For example, the second embedded system may analyze all the remaining temporary work orders or a select number of temporary work orders. The select number may be, for example, a series of temporary work orders (e.g., the next five temporary work orders) or the temporary work orders located within a designated distance (e.g., any work orders for restricted segments in the next km).

As described above, the trip plan may specify the limited time period in which a temporary work order is valid. Alternatively, the control system may receive information indicating when the work order terminates without use of the trip plan. For example, the input information received by the control system may indicate the time(s) that the work order is valid and/or an indication of whether the work order is currently valid and in-force without the control system having to resort to use of the trip plan to determine whether a work order is valid.

Using the current time (or local time), the second embedded system may determine whether the temporary work order has expired. If the temporary work order has expired (or subsequent temporary work orders have expired), the method may at least one of (1) generate a new trip plan, (2) prompt or query, at 264, the human operator to confirm that the temporary work order has expired, or (3) modify, at 265, the operational settings of the trip plan such that the vehicle system exceeds the maximum speed through the restricted segment. In some embodiments, the method may perform more than one of the above steps. For example, after determining that the temporary work order has expired, the operator may be prompted or queried to confirm that the temporary work order has expired. Upon receiving confirmation from the operator, the operational settings are modified to increase the vehicle speed. As the vehicle speed is increased, a new trip plan may be generated. As another example, after determining that the temporary work order has expired, the operational settings may be automatically modified to increase the vehicle speed. As the vehicle speed is increased, a new trip plan may be generated. Yet in another example, after determining that the temporary work order has expired, a new trip plan may be generated. The last example may be performed when, for instance, a subsequent temporary work order has expired.

If the temporary work order has not expired, the method may return to controlling the vehicle system according to the trip plan. If the second embedded system determines that the temporary work order has expired, but the human operator does not confirm the expiration of the temporary work order, the method may return to controlling the vehicle system according to the trip plan.

As described herein, the method may automatically generate a new trip plan in response to determining that the temporary work order (or temporary work orders) has expired. This automatic path is indicated by the dashed line between the query 262 and the block 254. It should be understood, however, that both paths may be taken. For example, after determining that the temporary work order has expired, the method may ask the human operator whether the temporary work order has expired and also automatically instruct the control system (or first embedded system) to begin generating a new trip plan.

When the control system asks the human operator to confirm that the temporary work order has expired, the control system may display the temporary work order (or orders) on a user interface (e.g. user display, screen, touchscreen, or the like) that is disposed onboard the vehicle system. For example, the second embedded system may identify the temporary work order by an order number or by mile markers. The second embedded system may also display the limited time period for the temporary work order. The human operator may then determine whether the temporary work order has expired. The human operator may also communicate remotely to determine whether the temporary work order has expired.

When a new trip plan is generated the first embedded system (or the control system) may generate a new trip plan in which the vehicle system exceeds the maximum speed through the restricted segment with the expired work order. Returning to FIG. 3, the restricted segment includes an alternative speed profile in which the vehicle system exceeds the maximum speed. This vehicle speed is referenced. Because the vehicle system was permitted to exceed the maximum speed for the restricted segment, the vehicle system may have a different speed profile for a remainder of the trip.

The new trip plan may be created to achieve one or more objectives. For example, the new trip plan may be configured to have at least one of (a) a new predicted trip duration that is essentially equal to the prior predicted trip duration or (b) a new predicted fuel consumption that is less than the predicted fuel consumption from the prior trip plan. In some embodiments, a trip duration is essentially equal to another trip duration if the trip durations are within 5% of each other. For example, if the trip duration of the original plan was 8 hours, the trip duration of the new trip plan is essentially equal to the original trip duration if the new trip duration is eight hours+/−24 minutes. In more particular embodiments, a trip duration is essentially equal to another trip duration if the trip durations are within 3% of each other or within 2% of each other. In some embodiments, a trip duration is essentially equal to another trip duration if the trip durations are within 15 minutes of each other. In more particular embodiments, a trip duration is essentially equal to another trip duration if the trip durations are within 10 minutes of each other or within 5 minutes of each other. Optionally, the new trip plan may have a slower average vehicle speed after the restricted segment compared to the average vehicle speed of the prior trip plan after the restricted segment.

When the new trip plan is generated the control system (or the first embedded system) may use only the prior trip plan and the new information that the temporary work order has expired. In other embodiments, the control system may use updated input information. For example, the first embedded system may communicate with a remote system (e.g., off-board system) that provides information that has changed since the last communication between the first embedded system and the remote system. The new or updated information is represented by the dashed arrow in FIG. 3.

FIG. 3 also illustrates how the predicted speed profile may change in the new trip plan after determining that the temporary work order for the restricted segment had expired. Three alternative profiles are shown. A first alternative (indicated at 222A, 222B) may be implemented if the temporary work order for the restricted segment remains valid during the trip. The vehicle system may coast toward the restricted segment. The vehicle system may have a decreased speed for a portion of the route because the vehicle system was permitted to travel at a greater vehicle speed through the restricted segment. In this example, the trip duration may be essentially equal and the fuel consumption during the trip may be less.

The portion of the speed profile referenced indicates a speed profile in which the temporary work order for the restricted segment has expired. In this example, the speed of the vehicle system may gradually decrease as the vehicle system approaches the final destination. The portion of the speed profile referenced indicates another speed profile in which the temporary work order for the restricted segment has expired. In this example, the speed of the vehicle system is greater to allow the vehicle system to arrive at the final destination earlier or to allow the vehicle system to make up for delays that occurred during the first half of the route.

In one embodiment, the control system onboard a vehicle system can dictate the operational settings to be implemented by the vehicle system during movement that approaches, passes through, and/or exits a route segment associated with one or more work orders. The control system can dictate these operational settings by automatically controlling the propulsion system and/or brake system of the vehicle system such that the vehicle system moves according to or in congruence with the operational settings. These operational settings can be part of the trip plan described above, can be determined based on manual input provided by the operator of the vehicle system, and/or can be automatically determined by the control system. For example, the control system can determine the speed limit of the route (whether reduced by the work order or not), the distance to other vehicles and/or objects on the route, the weather conditions, etc., and can generate the operational settings to ensure that the vehicle system does not violate the speed limit, collide with another object or vehicle, and travels at a safe speed based on the weather conditions, without having access to or creating any trip plan.

The control system can determine at least some of the operational settings based on a transitory speed limit of the segment of the route that is associated with or under the purview of the temporary work order. The speed limit is transitory in that the speed limit is only applicable while the work order is valid, in-force, or otherwise enforceable. For example, prior to the start of a work order, the route segment may have a first speed limit. Upon the starting time of the work order, the speed limit of the route segment may be reduced from the first speed limit to a slower, second speed limit. This second speed limit can be in-force during the work order. Upon expiration or termination of the work order, the speed limit of the route segment may increase to the first speed limit. The speed limits may be "in-force" when the vehicle systems are automatically prevented from traveling faster than the speed limits, when moving faster than the speed limits violates a law or regulation, or when the operator and/or owner of the vehicle system agrees to not move the vehicle system faster than the speed limits.

As described above, the control system determines whether the work order is currently applicable by determining and comparing a current time with the start time and/or end time of the work order. If the current time falls within the start time and end time, then the control system determines that the work order (and any applicable associated speed limits of the work order) is in-force. For example, if the current time is after the start time of the work order but before the end time of the work order, then the control system determines that the reduced speed limit of the route segment is enforceable and the faster speed limit of the route segment before the work order is not enforceable. The control system can determine and compare the current time to the time period of the work order as the vehicle system approaches and/or travels within the route segment associated with the work order.

The control system can perform or direct implementation of one or more responsive actions in response to determining and comparing the current time with the time period of the work order. For example, the control system can determine whether the transitory speed limit of the work order has started, whether the transitory speed limit of the work order is still in effect (e.g., is still in-force or enforceable), and/or whether the transitory speed limit of the work order has expired based on the comparison of the current time to the time period of the work order. The control system can generate and/or direct an output device (e.g., an electronic display, a light, a speaker, or the like) to generate a prompt indicating that the work order is in-force, has not yet started, or has terminated, as applicable. For example, if the vehicle system is approaching and/or traveling within the route segment associated with the work order and the control system determines that the work order has started but has not yet expired, the control system can generate a prompt that notifies the operator of the vehicle system that the vehicle system is approaching and/or traveling within the route segment having the reduced speed limit of the work order. As another example, if the vehicle system is approaching and/or traveling within the route segment associated with the work order and the control system determines that the work order has not yet started or has expired, the control system can generate a prompt that notifies the operator of the vehicle system that the vehicle system is approaching and/or traveling within the route segment having the faster speed limit than the reduced speed limit of the work order. Stated differently, the control system can notify the operator that the work order has ended or not yet started.

The expiration of a work order can occur while the vehicle system is traveling in the route segment associated with the work order. For example, the vehicle system may enter the route segment having the reduced speed limit of the work order after the work order has started but prior to termination of the work order. The work order may terminate before the vehicle system has left this route segment.

If the work order having the reduced speed limit has expired (before the vehicle system enters the route segment of the work order or while the vehicle system moves in this route segment), the control system can control the propulsion and/or braking systems of the vehicle system to increase the speed of the vehicle system above the reduced speed limit of the work order while the vehicle system propels itself through the route segment of the expired work order.

For example, the vehicle system may enter into a route segment having a currently enforceable work order with a reduced speed limit. The control system can automatically control the movement of the vehicle system to move no faster than the reduced speed limit. This can occur by the control system automatically setting the throttle settings, brake settings, power outputs of the propulsion system, etc., and/or by the control system disregarding or changing manual inputs from the operator that would cause the vehicle system to travel faster than the reduced speed limit of the work order. Before the vehicle system exits the route segment of the work order, the work order may expire or no longer be enforceable. The vehicle system can then automatically control the vehicle system to speed up to a speed that is faster than the reduced speed limit of the expired work order such that the vehicle system moves faster than the reduced speed limit of the expired work order in the route segment of the expired work order. The control system optionally can control the vehicle system to move no faster than the current, faster speed limit of the route segment (e.g., faster than the speed limit of the work order).

The route segment associated with a work order may have more than one vehicle system on or in the route segment. For example, a long route segment having a currently in-force work order may have two or more separate vehicle systems traveling in the same direction on the same route segment. If the work order expires while these vehicle systems are in the route segment, the control systems of the vehicle systems can communicate (unidirectionally and/or bi-directionally) to avoid collision between the vehicle systems. The trailing vehicle system may determine that the work order has expired before the leading vehicle system. Optionally, the trailing vehicle system may accelerate faster to the increased speed limit of the route segment (now that the reduced work order speed limit has expired) than the leading vehicle system. The control system of the trailing vehicle system can communicate with the control system of the leading vehicle system to avoid a collision between the vehicle systems.

For example, the control system of the trailing vehicle system (referred to as the trailing control system) can communicate a signal to the control system of the leading vehicle system (referred to as the leading control system) to notify the leading control system that the work order has expired and the leading vehicle system can speed up to speeds above the reduced speed limit of the expired work order. As another example, the trailing control system can communicate with the leading control system to determine the location and/or moving speed of the leading vehicle system in response to determining that the work order has expired. The trailing control system can then control movement of the trailing vehicle system to avoid the trailing vehicle system overtaking and colliding with the leading vehicle system.

A route segment can have multiple work orders in place at the same time. This can be referred to as a multi-order route segment. Different work orders can have different reduced speed limits. For example, a route segment can have two different work orders that are concurrently in force. A first work order can be associated with a first reduced speed limit (that is slower than the speed limit of the route segment without any work orders) and a second work order can be associated with a slower, second reduced speed limit (that is slower than the first reduced speed limit). These work orders can be associated with different start and/or end times such that one work order may be in-force for a first time period, then multiple work orders may be in-force at the same time for a subsequent second time period, then one or more of the work orders may have expired while one or more other work orders remain in-force for a subsequent third time period.

The control system can determine the locations, start times, and end times for the work orders associated with the multi-order route segment. The control system can then determine and compare the location of the vehicle system and the time with the locations and times of the work orders. The control system can identify which work orders are applicable and in-force based on the location of the vehicle system and the time. If the work orders do not have the same reduced speed limit, the control system can identify the most restrictive (e.g., slowest) of the applicable speed limits and control the vehicle system to move no faster than the slowest speed limit. Once one of the work orders expires, the control system can determine which of the multiple work orders remain in-force based on the location of the vehicle system and time. The control system can then determine the most restrictive speed limit of the remaining work orders that are in-force and restrict movement of the vehicle system to travel no faster than this speed limit.

In one embodiment, temporal period of a work order can be based on one or more other factors. A work order can start and/or stop based on a holiday schedule. For example, some holidays are associated with increased travel of vehicle systems on routes. A work order can be implemented to start at a date and/or time when route traffic increases for a holiday and to end at a date and/or time when route traffic decreases after the holiday. As another example, some days of the week are associated with increased travel of vehicle systems on routes. A work order can be implemented to start on days associated with increased route traffic and to end before days associated with reduced route traffic. For example, a work order can be implemented to reduce the speed limit for a route or route segment on Mondays, Tuesdays, and Fridays, but not be implemented on other days of the week.

As another example, a work order can be in-force during times associated with increased travel of vehicle systems on routes. For example, a work order can be implemented during rush hours of an urban area to reduce the speed limit of routes. The work order can be eliminated or not in-force before and after the rush hours.

A work order can be in-force during dynamically changing times. For example, work orders can be implemented to reduce the speed limits of route segments based on changing traffic patterns. That is, instead of or in addition to starting and stopping of a work order being fixed to designated days or times (which can be determined based on historical evidence), the work orders can be implemented responsive to traffic congestion increasing above a designated threshold and terminated responsive to traffic congestion decreasing to or below the threshold.

As another example, work orders can be implemented during increased power consumption times and terminated after increased power consumption times end. The power consumption can be the electric current that is supplied to the propulsion systems of vehicle systems, such as from an overhead catenary, a powered rail, etc. The vehicle systems can include corresponding devices, such as pantographs, conductive shoes or brushes, or the like, for drawing electric current from the catenary, powered rail, etc., to power motors and/or other loads of the vehicle systems. Certain times of the day may be associated with increased demands for electric current. For example, times during which both businesses and residential buildings are drawing more current from a utility grid than other times can be peak demand times. In one embodiment, a work order may be implemented during peak demand times. This can reduce the speed limit (and, therefore, reduce the current drawn by vehicle systems from the grid) during peak demand times to reduce the current drawn from the grid (relative to not implementing the work order).

As another example, a work order can be implemented during certain weather conditions. A work order can be implemented responsive to a weather alert indicating reduced visibility (e.g., fog) or other hazardous conditions (e.g., high winds, significant precipitation, significant accumulation of snow and/or ice, tornadic activity, hurricanes, etc.). This can force vehicle systems to reduce speeds for safer travel during the adverse weather conditions.

The work orders can optionally cause or direct the vehicle systems to change operations in addition to or in place of changing speeds. For example, a control system can change an operation of a vehicle system other than speed in response to determining that the location and time indicates that the vehicle system is moving within a route segment associated with an in-force work order. The other operations that can be changed can include emissions generated by the vehicle system, fuel consumed (or a rate of fuel consumption) by the vehicle system, the type of fuel consumed by the vehicle system, acoustic sound generated by the vehicle system, activation of lights or other devices, etc. For example, a work order may restrict the amount of emissions generated by a vehicle system. Responsive to entering into a route segment subject to a work order, the control system can change throttle settings, brake settings, or the like, to reduce the amount of emissions generated by the vehicle system while traveling subject to the work order. This can allow for emissions-based work orders to be used in areas having increased emissions and/or tighter restrictions on emission generation (than other locations not associated with such a work order).

As another example, a work order may restrict the amount of fuel consumed and/or the rate of fuel consumed by a vehicle system. Responsive to entering into a route segment subject to a work order, the control system can change throttle settings, brake settings, or the like, to reduce the amount of fuel consumed and/or the rate at which fuel is consumed by the vehicle system while traveling subject to the work order. This can allow for fuel-based work orders to be used to reduce fuel consumption by vehicle systems.

As another example, a work order may restrict the type of fuel consumed by a vehicle system. Responsive to entering into a route segment subject to a work order, the control system onboard a hybrid vehicle system capable of consuming different fuels for propulsion can change which of the fuels is being consumed. Such a vehicle system can switch from consuming diesel fuel to natural gas, from consuming a liquid or gaseous fuel to being powered by electric energy stored in batteries, or between two other types of fuel or energy.

In another example, a work order may restrict the acoustic sounds generated by a vehicle system. Responsive to entering into a route segment subject to such a work order, the control system onboard a vehicle system can prevent the vehicle system from operating in certain states to reduce the noise generated by the vehicle system. For example, the control system can prevent the vehicle system from using dynamic braking, from operating at higher throttle settings, or the like, to reduce the noise generated by the vehicle system (relative to traveling in locations not subject to such a work order).

As another example, a work order may require the vehicle system to activate lights of the vehicle system during travel in the route segment under the work order. Responsive to entering into a route segment subject to such a work order, the control system onboard the vehicle system can automatically activate headlights of the vehicle system. These types of work orders can be implemented at night, during adverse weather conditions (e.g., fog, heavy precipitation, etc.), or the like.

As described above, vehicle control systems include a plurality interacting sub-systems referred to herein as segments. For example, a PVC or an NVC system may include an onboard segment that is disposed onboard the vehicle, a remote segment that issues instructions and communicates information to the vehicle systems, and a route segment that includes devices located along the route that communicate with the onboard segment and the remote segment. The remote segment may include a dispatch system that is programmed and/or configured to analyze a current status of the routes and provide and/or issue movement authorities to the onboard segments of the vehicle systems.

In operation, the remote segment may communicate with vehicle systems that are traveling along one or more routes of a network of routes. The remote segment may communicate input information with the vehicle systems prior to a trip or during the trip. The input information may include a movement authority for a portion of the route that the vehicle system is presently traveling along or will be traveling along and, optionally, other information relating to the route or the trip, such as a grade of the route or weather conditions. The movement authorities may be based on a current status of the network of routes, such as a location, direction, and speed at which the vehicle systems in the network are operating. The movement authorities may also be based on any slow orders that are applicable to segments of the routes.

The movement authorities may be configured to prevent collisions or other unwanted events or conditions along the routes. For example, a movement authority may not be given to a vehicle system for traveling along one block of a route if another vehicle system is currently occupying the block (e.g., traveling in an opposite direction). To this end, the remote system may organize the network of routes into a network of route segments or blocks. In some embodiments, the blocks are static. In other embodiments, the blocks may be characterized as moving blocks. A movement authority may correspond to one or more blocks of the network.

Figure 5:
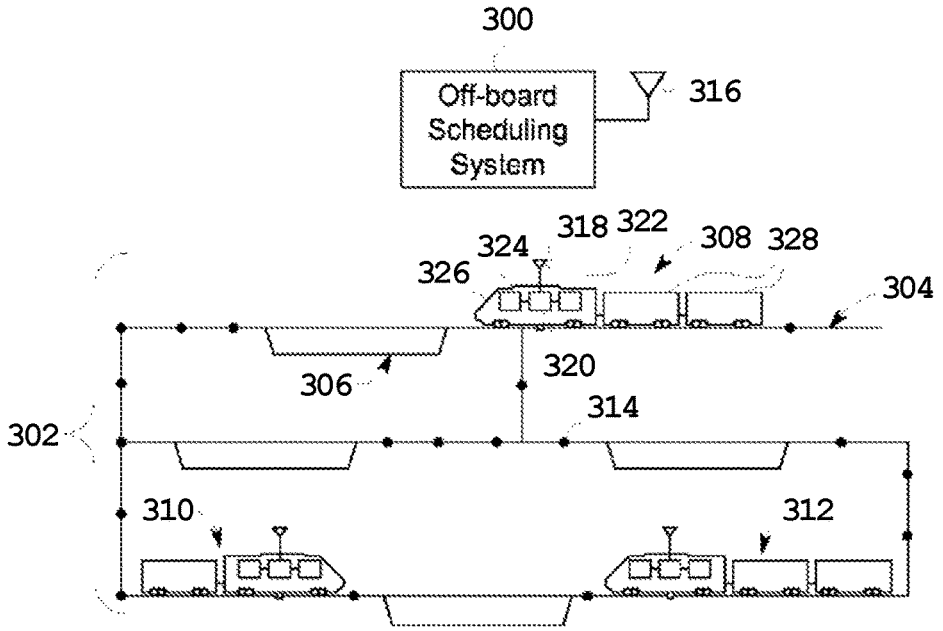
FIG. 5 is a schematic diagram of one embodiment of an off-board scheduling system and a transportation network.

FIG. 5 is a schematic view of one embodiment of a scheduling system 300 and a transportation network 302. One or more embodiments of the inventive subject matter described herein may provide a scheduling system that monitors several vehicle systems travelling in a transportation network of a plurality of routes. The vehicle systems travel in the transportation network according to one or more movement plans that are generated and/or output by the scheduling system. The scheduling system can represent hardware circuitry that includes and/or is connected with one or more processors that perform operations described herein in connection with the scheduling system. The transportation network can represent a network of two or more routes that may or may not be connected with each other.

The movement plan can provide schedules for the vehicle systems to move through the transportation network between various locations at various times. The scheduling system can create the movement plan for several vehicles to move through the transportation network while avoiding collisions or interfering with each other to the extent possible. The movement plan may include meet events between two or more vehicle systems. Meet events may occur along a common segment of a route. For example, a meet event can be a location and time at which first and second vehicle systems simultaneously travel toward each other in opposite directions along the common route segment. The first vehicle system may be scheduled to pass the second vehicle system when the second vehicle system pulls off of the common section of the route onto a side segment of the route. In the context of a railway, a meet event can include a location along the transportation network that includes a main segment of a rail track having a side segment of the track. In other contexts, such as those encountered by off-highway vehicles or marine vessels, the side segment may be an area adjacent to the main segment that is sized to receive the vehicle system to allow another vehicle system to pass. For off-highway vehicles, the side segment may be, for example, a smoothed or paved area (e.g., enlarged shoulder) alongside the main segment. For marine vessels, the main segment may be a passage defined by walls (e.g., of a canal) or a passage having a water depth that is suitable for the passing marine vessels. This passage may be bordered or defined between shallower waters. The side segment may be a region extending adjacent to the main segment that is sized and shaped to receive one or more marine vessels.

During a meet event, the second vehicle system moves off of the main segment to the side segment and may stop or decrease speed while the first vehicle system continues to move along the main segment and pass the second vehicle system. The first vehicle system that passes the second vehicle system at the meet event may be referred to as the passing vehicle system. The second vehicle system that moves to the side segment to allow another vehicle system to pass can be referred to as the yielding vehicle system.

The scheduling system may monitor the vehicle systems of the transportation network to determine whether vehicle systems are moving in accordance with the movement plans (e.g., reaching different points along the route by the estimated time of arrivals (ETAs)). In some embodiments, the scheduling system may receive communications informing the scheduling system that one or more vehicle systems will arrive at one or more subsequent points (e.g., waypoints 314) earlier (e.g., due to a faster speed profile) or that the vehicle system will arrive at one or more subsequent points later (e.g., due to a slower speed profile). A vehicle system may have a faster speed profile because, for example, the vehicle system has determined that a slow order for a route segment is no longer in effect as described herein.

As described herein, the vehicle system or the vehicle control system may generate or obtain a new trip plan responsive to determining that the work order is no longer in effect. The new trip plan may include a faster speed profile. The vehicle system may inform the scheduling system of the new trip plan and/or that the work order is no longer in effect (e.g., is not being enforced any longer). Based on this information, the scheduling system can modify or update a network plan of the vehicle systems of the transportation network. More specifically, the scheduling system may modify the movement plan of the vehicle systems or at least part of the movement plan (e.g., the part of the movement plan that dictates schedules for some, but fewer than all, of the vehicles concurrently moving within the transportation network).

As one example, the modified movement plan may include changes to one or more meet events. For instance, a meet event between two vehicle systems may occur at a different location (e.g., a different side segment). Alternatively or in addition to the modified movement plans including different locations for the meet events, the modified plans may instruct the vehicle systems to arrive at a waypoint sooner or later than the prior movement plan. In other words, the modified movement plans may allow a vehicle system to travel at a reduced speed or allow the vehicle system to travel at an increased speed, if possible.

As shown in FIG. 5, the transportation network includes a plurality of interconnected routes. In the illustrated embodiment, routes include main segment routes 304 and side segment routes 306. The transportation network may extend over a relatively large area, such as hundreds of square miles or kilometers of land area or water. Plural separate vehicle systems 308, 310, 312 travel along the routes. In the illustrated embodiment, the vehicle systems may include a group of powered vehicles 326 (e.g., locomotives) and/or non-powered vehicles 328 (e.g., cargo or passenger cars) that are mechanically coupled or linked together to travel along the routes. As shown, the main segment routes may be interconnected with each other to permit the vehicle systems to travel over various combinations of the routes to move from a starting location to a destination location. A main segment route may be a single lane shared by multiple vehicle systems moving in opposite directions. In order to avoid collisions between the vehicle systems traveling in opposite directions, the side segment route permits a yielding vehicle system to diverge or move aside for the passing vehicle system.

The vehicle systems travel along the routes according to respective movement plans generated by, for example, the scheduling system. For example, a movement plan may include a schedule for a respective vehicle system. In some embodiments, the movement plan includes a list, table, or other logical arrangement of geographic locations (e.g., GNSS or GPS coordinates) within the transportation network and associated times for the geographic locations. The geographic locations may represent or coincide with waypoints along the route.

As shown, the scheduling system can be disposed offboard (e.g., outside) of the vehicle systems of the transportation network. For example, the scheduling system may be disposed at a central dispatch office. The scheduling system communicates the movement plan of the vehicle systems or parts of the movement plan. Each movement plan may include a series of waypoints and associated times at which a corresponding vehicle system should reach the respective waypoint. The movement plan may include several different series or groups of waypoints (or other locations) and associated times at which different respective vehicles are to reach the waypoint or other location for the series or group of waypoints or locations for that vehicle. The scheduling system can include a wireless antenna 316 (and associated transceiver equipment), such as a radio frequency (RF) or cellular antenna, that wirelessly transmits the schedules to the vehicle systems. The vehicle systems include wireless antennas 318 (and associated transceiver equipment), such as RF or cellular antennas, that receive the schedules from the scheduling system.

Optionally, the wireless antenna communicates the movement plan to a subsystem of the vehicle system. For example, an energy management system 320 may be disposed onboard the vehicle system and may receive the movement plan. The energy management system may be embodied in a computer, computer processor, microcontroller, microprocessor, or other logic-based device, that operates based on one or more sets of instructions (e.g., software) stored on a tangible and non-transitory computer readable storage medium (e.g., hard drive, flash drive, ROM, or RAM). The energy management system may include a location determining device, such as a GNSS or GPS receiver, that identifies a current location of the vehicle and a timing device, such as a clock, that determines a current time of the vehicle system. The energy management system can compare the current location and time of the vehicle system to the received schedule to determine whether the vehicle system is ahead of schedule (e.g., is arriving at a scheduled waypoint before an associated scheduled time), behind schedule (e.g., is arriving at a scheduled waypoint after an associated scheduled time), or on time (e.g., is arriving at a scheduled waypoint at a scheduled time or within a predetermined time period of the associated scheduled time).

Based on the comparison between the current location and time of the vehicle system and the received schedule, the energy management system may generate control instructions that direct operation of a propulsion subsystem 322 of the respective vehicle system. The propulsion subsystem can include one or more traction motors, brakes, and the like, that provide tractive effort to propel the vehicle along the routes and provide braking efforts to slow or stop movement of the vehicle. The control instructions may include commands that direct an operator of the vehicle to change or set the tractive effort and/or braking effort supplied by the propulsion subsystem of the vehicle system, or commands that automatically change or set the tractive effort and/or braking effort. For example, if a vehicle system is behind schedule, the control instructions may reduce braking effort and/or increase tractive effort. If the vehicle system is ahead of schedule, the control instructions may increase braking effort and/or reduce tractive effort. The energy management system may be the system that creates or obtains trip plans for the vehicle.

Figure 6:
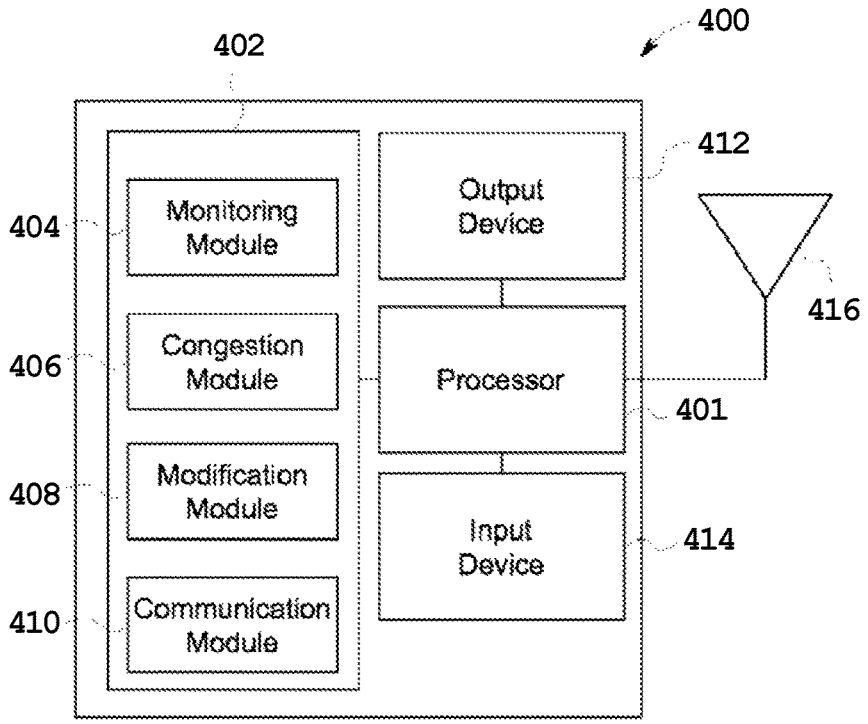
FIG. 6 is a schematic diagram of one embodiment of an off-board scheduling system.

FIG. 6 is a schematic diagram of one embodiment of an off-board scheduling system 400, which may be similar or identical to other scheduling systems described herein. The scheduling system includes one or more processors 401 (e.g., computer processors, microprocessors, controllers, microcontrollers, or other logic-based computer devices) that is communicatively coupled with a tangible and non-transitory computer readable storage medium 402, such as a computer hard drive, flash drive, RAM, ROM, EEPROM, and the like. The storage medium includes one or more sets of instructions that direct the processor to perform various operations or steps. For example, the storage medium can include software applications. In the illustrated embodiment, the sets of instructions are shown as a monitoring module 404, a congestion module 406, a modification module 408, and a communication module 410. Alternatively, one or more of the monitoring module, the congestion module, the modification module, and/or the communication module may be embodied in a processor. For example, one or more of the modules may be a dedicated processor or application specific integrated circuit (ASIC).

An output device 412 is communicatively coupled with the processors of the scheduling system. The output device presents information to an operator of the scheduling system. The information may include the schedules of vehicle systems in the transportation network, adherence of the vehicle systems to the schedules, and one or more parameters that characterize the efficiency of the transportation network. By way of example, the output device may include a computer monitor, touchscreen, a printer, a speaker, and the like. An input device 414 is communicatively coupled with the processor. The input device receives information from the operator and communicates the information to the processor. The operator may control operation of the scheduling system using the input device. By way of example, the input device may include a keyboard, electronic mouse device, stylus, touchscreen, microphone, and the like.

The monitoring module monitors the vehicle systems as the vehicle systems travel through the transportation network. The monitoring module can monitor or register locations of the vehicle systems. For example, each of the vehicle systems may periodically transmit the actual locations and/or times at which the actual locations are determined to the antenna of the scheduling system. The actual locations and times of the vehicle systems can be conveyed to the monitoring module so that the monitoring module can determine where the various vehicle systems are located within the transportation network.

The congestion module determines one or more parameters (called throughout parameters) of the transportation network. The throughput parameters can represent the flow or movement of the vehicle systems through the transportation network. A throughput parameter can be a statistical measure of adherence by one or more of the vehicle systems to the various schedules of the vehicle systems. For example, the statistical measure of adherence may be a quantity that is calculated for a vehicle system and that indicates how closely the vehicle system is following the schedule associated with the vehicle system. The statistical measure of adherence may be based on one or more time differences between (a) the scheduled time that the vehicle system is to arrive at or pass through a scheduled waypoint and (b) the actual time that the vehicle system arrives at or passes through the scheduled waypoint.

Figure 7:
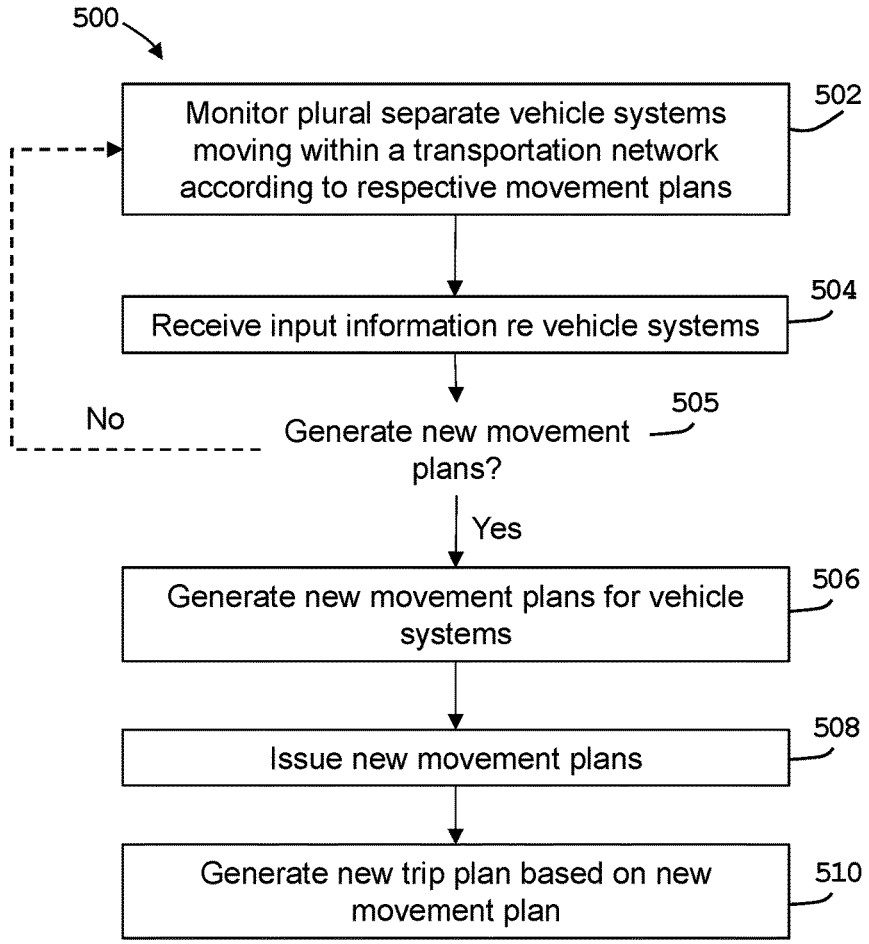
FIG. 7 is a flow chart illustrating a method (e.g., of adjusting a movement plan of a transportation network or operating a vehicle system) in accordance with an embodiment.

FIG. 7 includes a flowchart 500 illustrating one or more methods. The flowchart may illustrate, for example, a method of monitoring vehicle systems in a transportation network and/or modifying one or more movement plans of the vehicle systems. As described herein, one or more embodiments may monitor, at 502, numerous vehicle systems of a transportation network. The vehicle systems may be traveling in accordance with one or more movement plans. Monitoring the vehicle systems may include receiving input information, such as time and location data that identifies when the vehicle systems reach designated waypoints along the route.

In addition to input information regarding when the vehicle systems reach the designated waypoints, the method may include receiving, at 504, input information that permits adjusting one or more current movement plans. For example, responsive to determining that a slow order is no longer in effect, vehicle systems may generate new trip plans having, for example, new speed profiles as described herein. In some embodiments, the vehicle system may generate a single trip plan having a predicted speed profile and communicate the single trip plan and/or speed profile to the scheduling system. In other embodiments, the vehicle system may generate multiple possible trip plans having respective speed profiles. The vehicle system may communicate the multiple trip plans and/or respective speed profiles to the scheduling system.

It should be understood that generating or communicating multiple trip plans and/or speed profiles is not limited to generating and communicating individual trip plans and/or speed profiles. For example, the vehicle system may generate and communicate a table of information that includes the multiple waypoints. For each waypoint, a time range may be provided representing a range of possible ETAs that the vehicle system may accomplish. The table may inform the scheduling system of what the vehicle system could achieve. In some embodiments, the input information may include other operating parameters, such as predicted fuel consumption, predicted fuel emissions, or the like.

At 505, the method includes determining whether new movement plans should be generated. In some embodiments, the method includes automatically determining new movement plans after a determined period of time (e.g., 5 minutes, 10 minutes, 30 minutes, one hours, multiple hours). The method may automatically determine new movement plans if designated conditions have been met. For example, if a vehicle system reaches a designated waypoint or is predicted to reach a designated waypoint by a determined time prior to the scheduled arrival time (or by a determined time period prior to the scheduled arrival time (e.g., 30 minutes prior)), then the movement plans for one or more vehicle systems may be re-determined (or updated). Such instances may occur after it is determined that a restricted segment no longer has a slow order applied to the restricted segment. The vehicle systems having movement plans re-determined may include, for example, the early vehicle system and any other vehicle systems that are predicted to have a meet event with the early vehicle system or move along a common route as early the vehicle system.

As another example, if a vehicle system reaches a designated waypoint or is predicted to reach a designated waypoint by a determined time after the scheduled arrival time (or after a determined time period after the scheduled arrival time), then the movement plans for one or more vehicle systems may be determined. The vehicle systems having movement plans re-determined may include, for example, the late vehicle system that has arrived late to a designated waypoint or is predicted to arrive late to a designated waypoint.

Other designated conditions may include reports of damage along the route, emergencies along the route, or reports of adverse weather conditions. Moreover, reports of environmental factors, such as smog alerts or the formation of atmospheric inversion layers, may trigger generation of new movement plans.

As another example, the movement plans of one or more vehicle systems may be re-determined (or updated) if a priority status of a vehicle system or systems has changed. For example, the scheduling system may receive an order to raise the priority of one or more vehicle systems transporting certain cargo. The scheduling system may re-determine movement plans to enable the higher-priority vehicle system to arrive earlier at a designated waypoint.

The movement plans optionally can be updated or created based on one or more designated conditions occurring or being detected, and based on a type of vehicle. Different types of vehicles may be powered using different power sources. One type of vehicle consumes liquid fuel, while another vehicle may be powered by electric energy stored in onboard energy storage devices (e.g., capacitors, batteries, etc.). Another type of vehicle may consume gaseous fuel, another type of vehicle can consume multiple different types of fuels (e.g., different mixtures of different fuels at different times), another type of vehicle may switch between being powered by different sources at different times (e.g., a hybrid vehicle that can consume a liquid or gaseous fuel during a first time period and be powered by fuel cells or batteries at another time), etc.

In one example, the movement plan that is created may dictate the type of power source that one or more vehicles are to use in one or more different areas or locations within the transportation network. The movement plan can direct different types of power sources for a vehicle at different locations or areas based on one or more of the designated conditions described herein. For example, an area may be associated with an upper limit on audible noise created by vehicles moving through the area. These types of areas can be referred to as quiet zones, as one example. The movement plan may direct vehicles moving through an area defined as a quiet zone to switch from a first power source that creates more audible noise (e.g., fuel that is consumed by a combustion engine) to a different, second power source that creates less audible noise (e.g., electric energy from batteries). The vehicle moving according to this movement plan can use fuel to power the vehicle outside of the area, but switch to powering the vehicle with energy stored in batteries (or obtained from an off-board source, such as an electrified rail, overhead catenary, etc.) for movement within the area. The vehicle can switch back to using fuel to power the vehicle responsive to exiting this area.

Another area can be associated with a designated weather condition or upper limit on vehicle emissions. For example, an area in the transportation network may have an atmospheric inversion layer formed in the atmosphere and/or may have a level of smog that exceeds an upper threshold. The movement plan may direct vehicles moving through an area having an atmospheric inversion layer or increased smog to switch from a first power source that creates more emissions (e.g., fuel that is consumed by a combustion engine) to a different, second power source that creates fewer emissions (e.g., electric energy from batteries). The vehicle moving according to this movement plan can use fuel to power the vehicle outside of the area, but switch to powering the vehicle with energy stored in batteries or obtained from an off-board source for movement within the area. The vehicle can switch back to using fuel to power the vehicle responsive to exiting this area.

Optionally, the movement plan can be created by the scheduling system to identify upcoming areas for scheduled movement of a vehicle to identify the designated areas (e.g., areas having limits on noise and/or emissions). The scheduling system can create or modify the movement plan and/or the onboard controller of the vehicle can change operation of the vehicle to ensure that the vehicle has sufficient electric energy to travel through these areas. For example, a movement plan may direct the vehicle to use a source of energy other than electric energy (e.g., fuel) prior to reaching a designated area (e.g., associated with a noise or smog limit, having an atmospheric inversion layer, or having another limitation that prevents usage of fuel to power the vehicle while in the area). This can prevent the vehicle from expending too much stored electric energy before reaching the area. Stated differently, the movement plan can direct the vehicle to conserve the stored electric energy to ensure that there is enough energy stored (e.g., in batteries) onboard the vehicle to power the vehicle through the designated area(s).

Conversely, the movement plan may direct the vehicle to use a source of electric energy prior to reaching a designated area due to electric energy being unavailable in the area. For example, the area may include locations having an electric power outage, that do not have an electrified rail, that do not include an overhead catenary, etc. The movement plan can direct the vehicle to use electric energy to propel the vehicle prior to reaching the area to ensure that the vehicle has sufficient fuel onboard the vehicle to ensure that the vehicle can propel itself through the area.

At 506, new movement plans may be generated and issued, at 508. FIG. 7 illustrates how the modified movement plans may change meet events. FIG. 7 is a schematic diagram of a portion of a transportation network 600 that may be similar or identical to other transportation networks described herein. The illustrated portion includes a route 601. The route includes a first side segment 608, a second side segment 610, and a third side segment 612 that each extend alongside a main segment 602. When viewed left-to-right, branch segments 604, 606 merge to form the main segment. Although not shown, the branch segments may also constitute main segments having one or more side segments. One of the branch segments includes a restricted segment 607 that is subject to a slow order (e.g., temporary work order). As described herein, the slow order may exist for a determined time period having a start time and a stop time. Also shown, the transportation network includes a first vehicle system 620, a second vehicle system 622, and a third vehicle system 624. The third vehicle system is heading in an opposite direction with respect to the first and third vehicle systems.

Figure 8:
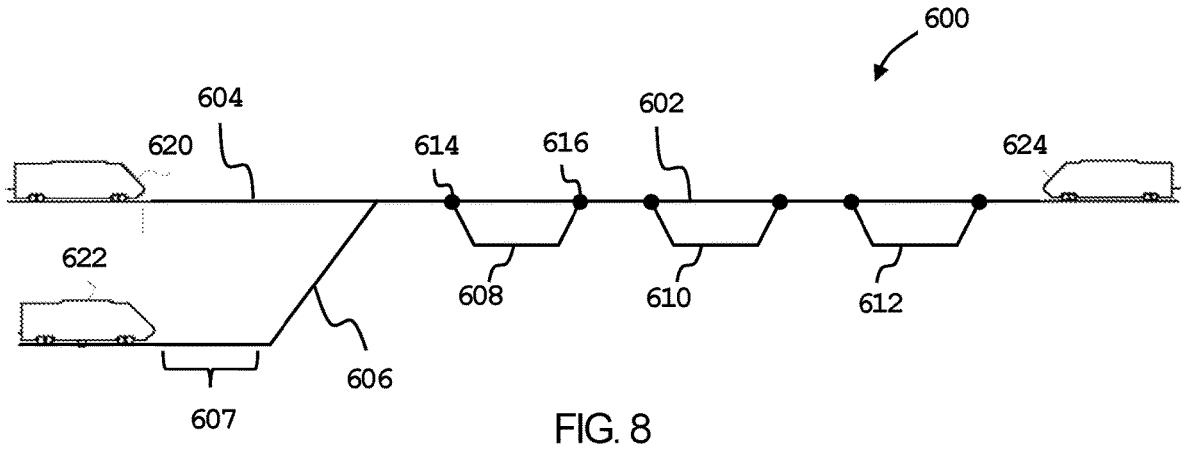
FIG. 8 is a schematic diagram of a portion of a transportation network having multiple vehicle systems.

In some embodiments, the movement plans may change the locations and timings of meet events, among other things. With respect to the scenario shown in FIG. 8, the movement plans of the vehicle systems may be based on an assumption that a slow order will remain in effect as the second vehicle system moves through the restricted segment. However, if it is determined that the slow order will expire prior to the second vehicle system entering the restricted segment or will expire as the second vehicle system moves through the restricted segment, then the second vehicle system will arrive at subsequent waypoints (e.g., the waypoint 614) earlier than scheduled. If the second vehicle system communicates to the scheduling system that the second vehicle system will arrive earlier, then the scheduling system may generate new movement plans for the first and second vehicle systems. As such, a meet event along the first side segment in which the second vehicle system passes the first vehicle system may be omitted. More specifically, the first vehicle system may be instructed to decrease speed so that the second vehicle system merges onto the main segment 602 in front of the first vehicle system.

Alternatively, if the first vehicle system has a higher priority than the second vehicle system but is not moving at maximum speed, the movement plans may designate new arrival times for subsequent waypoints that effectively instruct the first vehicle system to increase speed. Alternatively or in addition to the above, the movement plans may designate arrival times to the second vehicle system for subsequent waypoints that effectively instructs the second vehicle system to decrease speed. In a similar manner, meet events with oncoming vehicle systems, such as the third vehicle system in FIG. 8, may be changed so that the meet events occur at different times and/or locations.

At 610, new trip plans for the respective vehicle systems may be generated. The new trip plans may be configured to satisfy the new movement plans issued by the scheduling system. In some embodiments, the new trip plans may be generated at least partially or entirely onboard. In other embodiments, the new trip plans may be generated at least partially or entirely off-board. In particular embodiments, the new trip plans may be generated by the scheduling systems.

Figure 9:
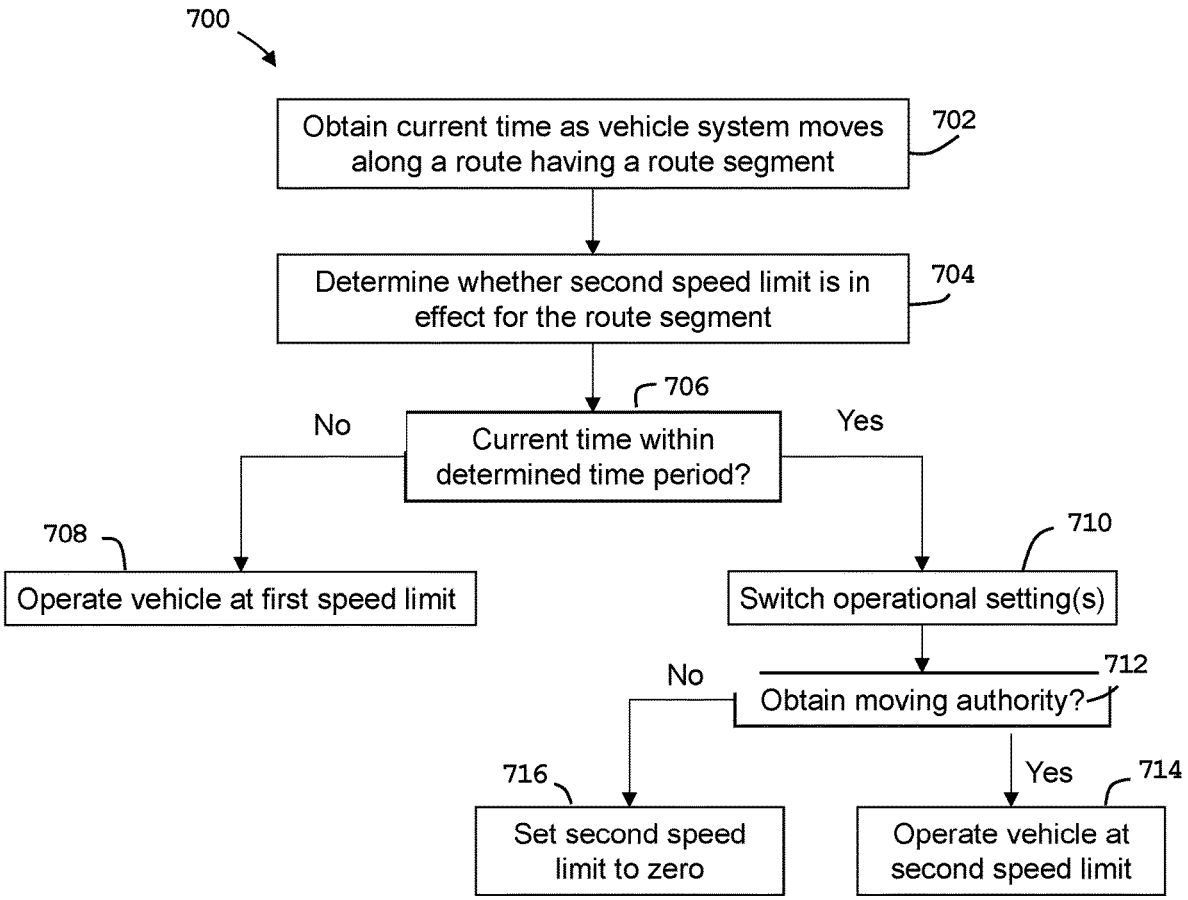
FIG. 9 is a flow chart illustrating a method (e.g., of controlling a vehicle system) in accordance with an embodiment.

FIG. 9 is a flowchart illustrating a method of controlling a vehicle system. The method 700 may be carried out, in some embodiments, by a PVC system having a communication and signaling system that uses signals and sensors along a route to communicate a location of the vehicle system, speed restrictions, and moving authority. Moving authorities may permit the vehicle system to move through the segment at a non-zero speed. If the vehicle system is violating a speed restriction or moving authority, onboard equipment may automatically slow or stop the vehicle system. Embodiments may include the controller (e.g., PVC controller disposed onboard or off-board) functioning to stop movement of the vehicle system in the absence of a moving authority. The vehicle system may be stopped with respect to a designated segment along the route, at a designated time (or time period), or for both. For example, the controller may switch the operating mode of the vehicle system from a first speed limit to a second speed limit of zero in response to determining that the vehicle system is at a designated location (e.g., within a certain distance from a work zone), is within a designated time period, and lacks moving authority.

The method in FIG. 9 may include elements or steps that are similar to other methods described herein. For example, the method may include obtaining a current time, at 702, as the vehicle system moves along a route having a route segment. For example, the vehicle system may be approaching a route segment that is under a slow order. At 704, it may be determined whether a second speed limit is in effect for the route segment.

Determining whether the second speed limit is in effect may include, at 706, comparing a current time to a time period of the slow order. The time period may have a start time and a stop time. If the current time is within the time period, then the method may include, at 710, switching operational settings (e.g., of at least one vehicle of the vehicle system) for operating with respect to a first speed limit to operating with respect to the second speed limit. The first speed limit may be, for example, the speed limit of the route segment if no slow order were applied.

At 712, it may be queried whether a moving authority has been obtained by the vehicle. For example, an operator of the vehicle system may receive a moving authority from a PVC system. The moving authority may be issued if, for example, the operator of the vehicle system can confirm that a local crew member (e.g., engineer in charge) has confirmed that the slow order has expired or that the vehicle system may move through the route segment at the second speed limit. If the operator cannot confirm, the moving authority is not issued. For some embodiments, if the moving authority is not received by a designated time or by a designated location along the route, the second speed limit is set to zero, at 716, and the vehicle system is automatically slowed to a stop. If the moving authority is obtained, then the vehicle system may be operated or control to move through the route segment at or below the second speed limit.

One or more embodiments may include a system for a vehicle system to move along a route under a first speed limit. The system may include a controller, such as one or more controllers described above, that is configured to determine whether a second speed limit, which is less than or equal to the first speed limit, is in effect for a segment of the route. The controller may determine whether the second speed limit is in effect for the segment of the route by determining, as described above, a current time and comparing it to a time period of work order that corresponds to the segment of the route. Alternatively, the controller may determine whether the second speed limit is in effect by communicating with the remote segment (e.g., dispatcher) or other remotely located device.

In yet another embodiment, the controller may communicate with a local communication system associated with the segment. For example, if the segment of the route is a work zone, the controller may communicate with a communication system that is controlled by or associated with the construction crew working along the work zone or that is controlled by another local entity that is enabled to provide such information. Alternatively, one or more members of the crew onboard the vehicle system may confirm that the segment of the route is no longer under a slow order and provide user inputs that confirm the slow order has expired. For example, an operator of the vehicle system may communicate with an engineer that is responsible for the work zone and confirm that the slow order for the work zone has expired. The controller determines that the slow order has expired by receiving user inputs from the operator.

The controller may be configured to operate the first vehicle at the first speed limit outside of the segment of the route and operate the first vehicle at or below the second speed limit while the first vehicle is approaching or within the segment of the route. For example, the controller may be configured to switch one or more operational settings of one or more vehicles of the vehicle system. The operational settings may be changed between the operational settings for moving the vehicle system at the first speed limit and the operational settings for moving the vehicle system at the second speed limit. The controller may also be configured to switch the operational settings for other speed limits or modes of operations.

In some cases, the second speed limit may be a non-zero value, such as a speed slower than the first speed limit thereby enabling the vehicle system to move through the segment. For other scenarios, the second speed limit may be zero. In such instances, the operational settings for moving the vehicle system at the second speed limit are configured to stop movement of the vehicle system.

Optionally, the second speed limit may be transitory for a determined time period of the segment. The determined time period may have a start time and a stop time. The controller may be configured to obtain a current time as the vehicle system approaches, enters, or moves through the segment.

As described above, the controller may compare the current time to the determined time period and determine if the vehicle system is approaching or within the segment of the route. For example, the controller may determine a location of a first vehicle of the vehicle system (e.g., one of the leading vehicles of the vehicle system). If the current time is within the designated period, the controller may be configured to operate the first vehicle at the second speed limit. If the controller determines that the current time is at or after the stop time of the determined time period, the controller may continue to operate at the first speed limit or may switch the operating mode so that the vehicle operates at the first speed limit.

Optionally, the remote segment may issue and the controller may obtain a moving authority for the vehicle system. For example, the moving authority may be applicable to the vehicle system as a whole or just to one of the vehicles (e.g., the leading vehicle that is approaching or within the segment during the determined time period). If the moving authority is received, the vehicle and the vehicle system may proceed through the segment. If the moving authority is not received, the controller may set the second speed to zero. For example, if the moving authority is not received within a certain time period or by when the vehicle system reaches a certain location along the route, the controller may assume authority was denied and set the second speed limit to zero.

Optionally, the controller may determine if a location of the vehicle system is at a designated break location and the time period is at a designated break time. Responsive to this determination, the controller may set the speed limit to zero.

One or more embodiments may include a system for a vehicle system to move along a route under a first speed limit. The system may include a controller configured to dictate operational settings to be implemented by the vehicle system based at least in part on a transitory second speed limit that is less than or equal to the first speed limit and which is issued for a determined segment of the route and for a determined time period. The time period may have a start time and a stop time. The controller is also configured to obtain a current time as the vehicle system approaches, enters, or moves through the determined segment and to determine whether the transitory second speed limit has started, is in effect, or has expired based on the current time relative to the determined time period. The controller may be configured to communicate to an off-board system (e.g., remote dispatcher, back office, and/or central office) whether the transitory second speed limit has started, is in effect, or has expired.

The controller may be configured to receive one or more control signals from the off-board system. The one or more control signals may indicated whether the vehicle system has a moving authority to move through the determined segment. In response to the one or more control signals indicating that the vehicle system has the moving authority, the controller may perform one or more of the following. The controller may generate a prompt, as described herein, to indicate that the vehicle system has the moving authority to move through the determined segment of the route. The controller may operate the vehicle system at the first speed limit. The controller may also modify the operational settings of the vehicle system to move at or exceed the second speed limit for the determined segment.

Optionally, the moving authority may permit the vehicle system to operate at the first speed limit. The controller may be configured to dynamically modify the operational settings of the vehicle system while the vehicle system is moving within the determined segment.

In some embodiments, the off-board system (e.g., remote dispatcher, back office, central office, and/or the like) may receive the determination made by the controller regarding whether the transitory second speed limit has started, is in effect, or has expired.

In some example embodiments, the device performs one or more processes described herein. In some example embodiments, the device performs these processes based on processor executing software instructions stored by a computer-readable medium, such as a memory and/or a storage component. A computer-readable medium (e.g., a non-transitory computer-readable medium) is defined herein as a non-transitory memory device. A memory device includes memory space located inside of a single physical storage device or memory space spread across multiple physical storage devices.

Software instructions may be read into a memory and/or a storage component from another computer-readable medium or from another device via the communication interface. When executed, software instructions stored in a memory and/or a storage component cause the processor to perform one or more processes described herein. Additionally or alternatively, hardwired circuitry may be used in place of or in combination with software instructions to perform one or more processes described herein. Thus, embodiments described herein are not limited to any specific combination of hardware circuitry and software.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

In one embodiment, the communication system may have a local data collection system deployed that may use machine learning to enable derivation-based learning outcomes. The communication system may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the communication system may include a policy engine that may apply one or more policies. These policies may be based at least in part on characteristics of a given item of equipment or environment. With respect to control policies, a neural network can receive input of a number of environmental and task-related parameters. These parameters may include an identification of a determined trip plan for a vehicle group, data from various sensors, and location and/or position data. The neural network can be trained to generate an output based on these inputs, with the output representing an action or sequence of actions that the vehicle group should take to accomplish the trip plan. During operation of one embodiment, a determination can occur by processing the inputs through the parameters of the neural network to generate a value at the output node designating that action as the desired action. This action may translate into a signal that causes the vehicle to operate. This may be accomplished via backpropagation, feed forward processes, closed loop feedback, or open loop feedback. Alternatively, rather than using backpropagation, the machine learning system of the controller may use evolution strategies techniques to tune various parameters of the artificial neural network. The maintenance system may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models is obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

In one example, a control system includes a controller that may determine whether a second speed limit, which is less than or equal to a first speed limit, is in effect for a segment of the route. The controller may switch one or more operational settings of a vehicle from the first speed limit to the second speed limit, and may operate the vehicle at the first speed limit outside of the segment of the route and operate the vehicle at or below the second speed limit while the vehicle is approaching or within the segment of the route.

The second speed limit may be zero (e.g., requiring the vehicle to be stationary). The second speed limit may be transitory for a determined time period. The determined time period may have a start time and a stop time. The controller may obtain a current time as the vehicle approaches, enters, or moves through the segment. The controller may compare the current time to the determined time period and determine whether the vehicle is approaching or within the segment of the route and if the current time is within the designated time period, and, if so, the controller may operate the vehicle at the second speed limit. The controller may obtain a moving authority for the vehicle approaching or within the segment during the determined time period, and, if not, the controller may set the second speed to zero.

The controller may switch an operating mode of the vehicle so that the vehicle operates at the first speed limit, which is non-zero, responsive to determining that the current time is at or after the stop time of the determined time period. The controller may determine whether a location of the vehicle is at a designated break location and the time period is at a designated break time, and responsively set the second speed limit to zero.

In another example, a method for controlling a vehicle may include determining whether a second speed limit (which is less than or equal to a first speed limit) is in effect for a segment of a route, switching one or more operational settings of a vehicle from the first speed limit to the second speed limit, and operating the vehicle at the first speed limit outside of the segment of the route and operating the vehicle at or below the second speed limit while the vehicle is on or in the segment of the route.

The second speed limit may be zero. The second speed limit may be transitory for a determined time period, with the determined time period having a start time and a stop time. The method also may include obtaining a current time as the vehicle approaches, enters, or moves through the segment. The method may include comparing the current time to the determined time period and determining whether the vehicle is approaching or within the segment of the route and whether the current time is within the determined time period, and, if so, the method may include operating the vehicle at the second speed limit.

The method also may include obtaining a moving authority for the vehicle that is approaching or within the segment during the determined time period, and, if not, the method may include setting the second speed limit to zero. The method also may include switching an operating mode of the vehicle so that the vehicle operates at the first speed limit, which is non-zero, responsive to determining that the current time is at or after a stop time of the determined time period. The method may include determining whether a location of the vehicle is at a designated break location and responsively setting the second speed limit to zero.

In another example, a system may include a controller that may dictate operational settings to be implemented by a vehicle based at least in part on a transitory second speed limit that is less than or equal to a first speed limit and which is issued for a determined segment of the route for a determined time period. The time period may have a start time and a stop time. The controller may obtain a current time as the vehicle approaches, enters, or moves through the determined segment. The controller also may determine that the transitory second speed limit has expired or will expire as the vehicle moves through the determined segment based on the current time relative to the determined time period. The controller may communicate to an off-board system information that includes at least one of: (a) a new trip plan based on a speed that exceeds the second speed limit through the route segment; (b) a new speed profile based on a speed that exceeds the second speed limit through the route segment; and/or (c) a new estimated arrival time for a subsequent point along the route that is prior to a scheduled arrival time for the point along the route. The controller may receive a new movement plan from the off-board system, the movement plan including target times-of-arrival for subsequent points along the route. The controller may dictate operational settings to be implemented by the vehicle based at least in part on the new movement plan.

The new movement plan may include a meet event in which the vehicle is instructed to pass or yield to another vehicle. The controller may generate a trip plan after receiving the new movement plan. The trip plan may be based on the new movement plan and may dictate operational settings as a function of time, location, and/or distance along the route. The controller may communicate a signal to one or more other vehicles also traveling within the determined segment. This signal may notify the one or more other vehicles of expiration of the determined time period of the transitory second speed limit. The signal to the one or more other vehicles may instruct the one or more other vehicles to speed up for avoiding collision between the vehicle and the one or more other vehicles. The determined time period of the transitory second speed limit may be based on one or more of a holiday schedule, a peak demand time of a utility grid, a traffic rush hour, or one or more weather conditions.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

a controller configured to determine whether a second speed limit, which is less than or equal to a first speed limit, is in effect for a segment of the route, the controller configured to switch one or more operational settings of a vehicle from the first speed limit to the second speed limit, the controller also configured to dynamically transition the vehicle from a first speed at or below the first speed limit outside of the segment of the route to a second speed at or below the second speed limit while the vehicle is approaching or within the segment of the route.

2. The system of claim 1, wherein the second speed limit is zero.

3. The system of claim 1, wherein the second speed limit is transitory for a determined time period, the determined time period having a start time and a stop time, the controller being further configured to obtain a current time as the vehicle approaches, enters, or moves through the segment.

4. The system of claim 3, wherein the controller is configured to compare the current time to the determined time period and determine whether the vehicle is approaching or within the segment of the route and if the current time is within the designated time period, and, if so, the controller is configured to operate the vehicle at the second speed limit.

5. The system of claim 3, wherein the controller is configured to obtain a moving authority for the vehicle approaching or within the segment during the determined time period, and, if not, the controller is configured to set the second speed to zero.

6. The system of claim 3, wherein the controller is configured to switch an operating mode of the vehicle so that the vehicle operates at the first speed limit, which is non-zero, responsive to determining that the current time is at or after the stop time of the determined time period.

7. The system of claim 3, wherein the controller is configured to determine whether a location of the vehicle is at a designated break location and the time period is at a designated break time, and responsively sets the second speed limit to zero.

8. A method comprising:

determining whether a second speed limit, which is less than or equal to a first speed limit, is in effect for a segment of a route;

switching one or more operational settings of a vehicle from the first speed limit to the second speed limit; and dynamically transition the vehicle from a first speed at or below the first speed limit outside of the segment of the route to a second speed at or below the second speed limit while the vehicle is on or in the segment of the route.

9. The method of claim 8, wherein the second speed limit is zero.

10. The method of claim 8, wherein the second speed limit is transitory for a determined time period, the determined time period having a start time and a stop time, the method further comprises: obtaining a current time as the vehicle approaches, enters, or moves through the segment.

11. The method of claim 10, further comprising comparing the current time to the determined time period and determining whether the vehicle is approaching or within the segment of the route and whether the current time is within the determined time period, and, if so, the method comprises operating the vehicle at the second speed limit.

12. The method of claim 8, further comprising obtaining a moving authority for the vehicle that is approaching or within the segment during the determined time period, and, if not, the method comprises setting the second speed limit to zero.

13. The method of claim 8, further comprising switching an operating mode of the vehicle so that the vehicle operates at the first speed limit, which is non-zero, responsive to determining that the current time is at or after a stop time of the determined time period.

14. The method of claim 8, further comprising determining whether a location of the vehicle is at a designated break location and responsively setting the second speed limit to zero.

15. A system comprising:

a controller configured to dictate operational settings to be implemented by a vehicle based at least in part on a transitory second speed limit that is less than or equal to a first speed limit and which is issued for a determined segment of the route for a determined time period, the time period having a start time and a stop time, the controller configured to obtain a current time as the vehicle approaches, enters, or moves through the determined segment, the controller also configured to determine that the transitory second speed limit has expired or will expire as the vehicle moves through the determined segment based on the current time relative to the determined time period, the controller configured to communicate to an off-board system information that includes at least one of: (a) a new trip plan based on a speed that exceeds the second speed limit through the route segment; (b) a new speed profile based on a speed that exceeds the second speed limit through the route segment; or (c) a new estimated arrival time for a subsequent point along the route that is prior to a scheduled arrival time for the point along the route, the controller configured to receive a new movement plan from the off-board system, the movement plan including target times-of-arrival for subsequent points along the route, the controller configured to dictate operational settings to be implemented by the vehicle based at least in part on the new movement plan.

16. The system of claim 15, wherein the new movement plan includes a meet event in which the vehicle is instructed to pass or yield to another vehicle.

17. The system of claim 15, wherein the controller is configured to generate a trip plan after receiving the new movement plan, the trip plan being based on the new movement plan and dictating operational settings as a function of time, location, or distance along the route.

18. The system of claim 15, wherein the controller also is configured to communicate a signal to one or more other vehicles also traveling within the determined segment, the signal notifying the one or more other vehicles of expiration of the determined time period of the transitory second speed limit.

19. The system of claim 18, wherein the signal to the one or more other vehicles instructs the one or more other vehicles to speed up for avoiding collision between the vehicle and the one or more other vehicles.

20. The system of claim 15, wherein the determined time period of the transitory second speed limit is based on one or more of a holiday schedule, a peak demand time of a utility grid, a traffic rush hour, or one or more weather conditions.

* * * * *